US012247733B2

(12) United States Patent
Kendrick et al.

(10) Patent No.: US 12,247,733 B2
(45) Date of Patent: Mar. 11, 2025

(54) PREFABRICATED INTEGRATED COMBUSTION ASSEMBLIES AND METHODS OF INSTALLING THE SAME INTO A COMBUSTION SYSTEM

(71) Applicant: ClearSign Technologies Corporation, Tulsa, OK (US)

(72) Inventors: Donald Kendrick, Bellevue, WA (US); William A. Santana, Maple Valley, WA (US); Colin James Deller, Tulsa, OK (US)

(73) Assignee: ClearSign Technologies Corporation, Tulsa, OK (US)

( * ) Notice: Subject to any disclaimer, the term of this patent is extended or adjusted under 35 U.S.C. 154(b) by 192 days.

(21) Appl. No.: 17/068,741

(22) Filed: Oct. 12, 2020

(65) Prior Publication Data

US 2021/0131660 A1 May 6, 2021

Related U.S. Application Data

(63) Continuation-in-part of application No. 15/549,957, filed as application No. PCT/US2016/018133 on Feb. 16, 2016, now Pat. No. 10,801,723.

(Continued)

(51) Int. Cl.

*F23D 14/02* (2006.01)
*F23C 99/00* (2006.01)

(Continued)

(52) U.S. Cl.

CPC ..... *F23C 99/001* (2013.01); *F23D 14/02* (2013.01); *F23D 14/126* (2021.05); *F23D 14/145* (2013.01); *F23D 14/147* (2021.05)

(58) Field of Classification Search

CPC ..... F23C 99/001; F23D 11/406; F23D 14/02; F23D 14/126; F23D 14/145; F23D 14/147

See application file for complete search history.

(56) References Cited

U.S. PATENT DOCUMENTS 1,739,161 A * 12/1929 McKee ..... F23D 14/64 138/44
2,582,577 A * 1/1952 Zink ..... F23D 14/82 239/132.5

(Continued)

FOREIGN PATENT DOCUMENTS

EP 0947769 A2 * 10/1999
GB 2148481 A * 5/1985 ..... F23C 3/002

(Continued)

OTHER PUBLICATIONS

Waterfall, Roger; Flame Visualizations Using Electrical Capacitance Tomography (ECT); Feb. 2, 2001; Proc. SPIE 4188, Process Imaging for Automatic Control (Year: 2001).*

(Continued)

*Primary Examiner* — Michael G Hoang
*Assistant Examiner* — Logan P Jones
(74) *Attorney, Agent, or Firm* — Crowe & Dunlevy, P.C.

(57) ABSTRACT

Embodiments disclosed herein are directed to devices and methods for improving operation of a combustion system. According to various embodiments disclosed herein, a prefabricated integrated combustion assembly is disclosed that may be installed into a combustion chamber of a combustion system. The combustion system may be a new combustion system that is being manufactured or a conventional combustion system that is being retrofitted.

20 Claims, 12 Drawing Sheets

Related U.S. Application Data

(60) Provisional application No. 62/117,401, filed on Feb. 17, 2015.

(51) Int. Cl.

| | |
|---|---|
| ***F23D 11/40*** | (2006.01) |
| ***F23D 14/12*** | (2006.01) |
| ***F23D 14/14*** | (2006.01) |

(56) References Cited

U.S. PATENT DOCUMENTS

| | | | | |
|---|---|---|---|---|
| 3,021,893 | A | 2/1962 | Honger | |
| 3,162,234 | A * | 12/1964 | Hamclink | F23N 5/22 431/46 |
| 3,488,137 | A | 1/1970 | Naganuma | |
| 4,021,188 | A | 5/1977 | Yamagishi et al. | |
| 4,081,958 | A | 4/1978 | Schelp | |
| 4,408,461 | A | 10/1983 | Bruhwiler et al. | |
| 4,473,349 | A | 9/1984 | Kumatsu | |
| 4,519,770 | A | 5/1985 | Kesselring et al. | |
| 4,588,373 | A | 5/1986 | Tonon et al. | |
| 4,601,655 | A * | 7/1986 | Riley | F23C 3/002 126/91 A |
| 4,673,349 | A | 6/1987 | Abe et al. | |
| 4,726,767 | A | 2/1988 | Nakajima | |
| 4,752,213 | A | 6/1988 | Grochowski et al. | |
| 4,773,847 | A | 9/1988 | Shukla et al. | |
| 5,326,257 | A | 7/1994 | Taylor et al. | |
| 5,375,999 | A | 12/1994 | Aizawa et al. | |
| 5,429,059 | A | 7/1995 | Wagoner et al. | |
| 5,441,402 | A | 8/1995 | Reuther et al. | |
| 5,511,974 | A | 4/1996 | Gordon et al. | |
| 5,641,282 | A | 6/1997 | Lee et al. | |
| 5,649,529 | A | 7/1997 | Lu et al. | |
| 5,957,682 | A | 9/1999 | Kamal et al. | |
| 6,095,798 | A | 8/2000 | Mitani et al. | |
| 6,159,001 | A | 12/2000 | Kushch et al. | |
| 6,206,686 | B1 | 3/2001 | Nieszczur et al. | |
| 6,270,336 | B1 | 8/2001 | Terashima et al. | |
| 7,204,688 | B2 * | 4/2007 | Han | F23D 14/70 431/350 |
| 7,927,095 | B1 * | 4/2011 | Chorpening | F23N 1/022 700/274 |
| 8,327,538 | B2 | 12/2012 | Wang et al. | |
| 9,377,190 | B2 | 6/2016 | Karkow et al. | |
| 9,388,981 | B2 | 7/2016 | Karkow et al. | |
| 9,447,965 | B2 | 9/2016 | Karkow et al. | |
| 9,562,682 | B2 | 2/2017 | Karkow et al. | |
| 2006/0141413 | A1 | 6/2006 | Masten et al. | |
| 2009/0307922 | A1 * | 12/2009 | Kim | D06F 58/263 432/222 |
| 2012/0017847 | A1 | 1/2012 | Ruiz et al. | |
| 2012/0164590 | A1 | 6/2012 | Mach | |
| 2012/0231398 | A1 | 9/2012 | Carpentier et al. | |
| 2013/0291552 | A1 * | 11/2013 | Smith | F23C 99/001 60/725 |
| 2014/0004471 | A1 | 1/2014 | Vandergriendt et al. | |
| 2014/0248570 | A1 | 9/2014 | Zhang et al. | |
| 2014/0295360 | A1 | 10/2014 | Wiklof | |
| 2015/0101591 | A1 | 4/2015 | Gulkanat | |
| 2015/0118629 | A1 | 4/2015 | Colannino et al. | |
| 2015/0276217 | A1 | 10/2015 | Karkow et al. | |
| 2015/0316261 | A1 | 11/2015 | Karkow et al. | |
| 2015/0330625 | A1 | 11/2015 | Karkow et al. | |
| 2015/0362177 | A1 | 12/2015 | Krichtafovitch et al. | |
| 2015/0362178 | A1 | 12/2015 | Karkow et al. | |
| 2015/0369477 | A1 | 12/2015 | Karkow et al. | |
| 2016/0003471 | A1 | 1/2016 | Karkow et al. | |
| 2016/0018103 | A1 | 1/2016 | Karkow et al. | |
| 2016/0025333 | A1 | 1/2016 | Karkow et al. | |
| 2016/0025374 | A1 | 1/2016 | Karkow et al. | |
| 2016/0025380 | A1 | 1/2016 | Karkow et al. | |
| 2016/0046524 | A1 | 2/2016 | Colannino et al. | |
| 2016/0091200 | A1 | 3/2016 | Colannino et al. | |
| 2016/0230984 | A1 | 8/2016 | Colannino et al. | |
| 2016/0238240 | A1 | 8/2016 | Colannino et al. | |
| 2016/0238277 | A1 | 8/2016 | Colannino et al. | |
| 2016/0238318 | A1 | 8/2016 | Colannino et al. | |
| 2016/0290639 | A1 | 10/2016 | Karkow et al. | |
| 2016/0298838 | A1 | 10/2016 | Karkow et al. | |
| 2016/0298840 | A1 | 10/2016 | Karkow et al. | |
| 2016/0305660 | A1 | 10/2016 | Colannino et al. | |
| 2016/0348899 | A1 | 12/2016 | Karkow et al. | |
| 2016/0348900 | A1 | 12/2016 | Colannino et al. | |
| 2016/0348901 | A1 | 12/2016 | Karkow et al. | |
| 2017/0010019 | A1 | 1/2017 | Karkow et al. | |
| 2017/0038063 | A1 | 2/2017 | Colannino et al. | |
| 2017/0038064 | A1 | 2/2017 | Colannino et al. | |
| 2017/0146232 | A1 | 5/2017 | Karkow et al. | |

FOREIGN PATENT DOCUMENTS

| | | | |
|---|---|---|---|
| JP | 55107811 | A * | 8/1980 |
| WO | 2014127305 | A1 | 8/2014 |
| WO | 2014127307 | A1 | 8/2014 |
| WO | 2015123149 | A1 | 8/2015 |
| WO | 2015123683 | A1 | 8/2015 |
| WO | 2016105489 | A2 | 6/2016 |
| WO | 2016133934 | A1 | 8/2016 |
| WO | 2016133936 | A1 | 8/2016 |

OTHER PUBLICATIONS

International Search Report and Written Opinion of the International Searching Authority for International Application No. PCT/US2016/018133 dated Apr. 21, 2016 (6 pages).

International Search Report and Written Opinion of the International Searching Authority for International Application No. PCT/US2016/018128 dated Apr. 19, 2016 (9 pages).

Thomas F. Fric, "Effects of Fuel-Air Unmixedness on NOx Emissions", Journal of Propulsion and Power, vol. 9, No. 5, Sep.-Oct. 1993, pp. 708-713.

* cited by examiner

PREFABRICATED INTEGRATED COMBUSTION ASSEMBLIES AND METHODS OF INSTALLING THE SAME INTO A COMBUSTION SYSTEM

CROSS-REFERENCE TO RELATED APPLICATION

The present application is a Continuation-in-Part (CIP) Application of co-pending U.S. patent application Ser. No. 15/549,957, entitled "PREFABRICATED INTEGRATED COMBUSTION ASSEMBLIES AND METHODS OF INSTALLING THE SAME INTO A COMBUSTION SYSTEM", filed Aug. 9, 2017. U.S. patent application Ser. No. 15/549,957 is a U.S. National Phase application under 35 U.S.C. 371 of PCT International Patent Application No. PCT/US2016/018133, entitled "PREFABRICATED INTEGRATED COMBUSTION ASSEMBLIES AND METHODS OF INSTALLING THE SAME INTO A COMBUSTION SYSTEM", filed Feb. 16, 2016. PCT International Patent Application No. PCT/US2016/018133 claims priority to U.S. Provisional Application No. 62/117,401, entitled "PREFABRICATED INTEGRATED COMBUSTION ASSEMBLIES AND METHODS OF INSTALLING THE SAME INTO A COMBUSTION SYSTEM", filed on Feb. 17, 2015. Each of the foregoing applications, to the extent not inconsistent with the disclosure herein, is incorporated by reference.

BACKGROUND

There are many different types of burners and combustion systems. Generally, a burner or combustion system includes a fuel nozzle that injects fuel into a combustion chamber. The fuel mixes with an oxidant, such as air, and after mixing, the fuel and oxidant mixture is ignited and combusted in the combustion chamber to generate heat. Furthermore, heat generated by the combustion system may be transferred and may raise the temperature of one or more objects and/or materials. For example, heat may be transferred from the combustion system to one or more pipes in a boiler system.

One or more pollutants may be produced during combustion of the fuel. Typically, such pollutants are exhausted into an outside environment and/or atmosphere and may have a negative impact on that environment. In addition, typical combustion systems operate below theoretical maximum efficiency for converting chemical energy of the fuel into heat, which may be transferred to one or more objects or materials that are heated by the combustion system.

Therefore, developers and users of burners and combustion systems continue to seek improvements to operating efficiency thereof and/or production of pollutants thereby.

SUMMARY

Embodiments disclosed herein are directed to devices and methods for improving operation of a combustion system. According to various embodiments disclosed herein, a prefabricated integrated combustion assembly is disclosed that may be installed into a combustion chamber of a combustion system. The combustion system may be a new combustion system that is being manufactured or a conventional combustion system that is being retrofitted.

An embodiment includes a method of installing a prefabricated integrated combustion assembly into a combustion chamber of a combustion system. The method includes inserting the prefabricated integrated combustion assembly into the combustion chamber of the combustion system. The prefabricated integrated combustion assembly includes a mounting flange mountable near a base of the combustion chamber and a fuel nozzle assembly attached to or integrated with the mounting flange. The fuel nozzle assembly includes a fuel nozzle and an oxidant outlet. Moreover, the prefabricated integrated combustion assembly includes one or more supports attached to or integrated with the mounting flange, and a perforated flame holder supported by the one or more supports and including a body defining a plurality of apertures therein. In addition, the method includes attaching the mounting flange of the prefabricated integrated combustion assembly near the base of the combustion chamber.

Embodiments are also directed to a prefabricated integrated combustion assembly to be installed into a combustion system. The prefabricated integrated combustion assembly includes a mounting flange mountable to a base of a combustion chamber of the combustion system and a fuel nozzle assembly attached to or integrated with the mounting flange. The mounting flange includes a mounting face and a back face. The fuel nozzle assembly includes a fuel nozzle having a tip thereof positioned at a predetermined distance from the mounting face of the mounting flange, and an oxidant outlet. The prefabricated integrated combustion assembly further includes one or more supports attached m to or integrated with the mounting flange and extending outward from the mounting face thereof. Additionally, the prefabricated integrated combustion assembly includes a perforated flame holder supported by one or more supports. The perforated flame holder includes a body defining a plurality of apertures. Furthermore, the perforated flame holder is positioned at a predetermined distance from the mounting face of the mounting flange and from the tip of the fuel nozzle.

According to an embodiment, an integrated combustion assembly includes a mounting flange mountable to a surface of a combustion chamber, the mounting flange including a mounting face and a back face; and a main fuel and combustion air source operatively coupled to the mounting flange, the main fuel and combustion air source including at least one main fuel nozzle and a combustion air source (1024), the at least one main fuel nozzle (1022) and the combustion air source being respectively configured to introduce a main fuel and combustion air into the combustion chamber in co-flow. One or more first supports may be operatively coupled to the mounting flange to extend from the mounting face of the mounting flange. A mixing tube may be operatively coupled to the one or more first supports, the mixing tube being aligned to receive the main fuel and the combustion air and disposed to facilitate mixing of the main fuel and the combustion air between an inlet of the mixing tube and an outlet of the mixing tube. One or more second supports may be operatively coupled to the mixing tube to extend from the outlet end of the mixing tube. A distal flame holder may be supported by the one or more second supports, the distal flame holder being positioned at a first predetermined distance from the mounting face of the mounting flange to hold a combustion reaction of the main fuel and combustion air.

According to an embodiment, a burner configured for deployment in a fire-tube boiler includes a mounting flange configured to be coupled to a base of a fire-tube boiler peripheral to a furnace opening. At least one main fuel nozzle configured to direct flow of a main fuel may be disposed proximate to the mounting flange. A combustion air source configured to provide a flow of combustion air may be operatively coupled to the mounting flange. A support member, operatively coupled to the mounting flange, may be configured to m provide cantilevered support to the burner in a horizontal cylindrical furnace within the fire-tube boiler. A distal flame holder may be disposed to receive mixed main fuel and combustion air to hold a main combustion reaction. A distal pilot burner may be operatively coupled to the support member. The distal pilot burner may be configured to guarantee combustion of mixed main fuel and combustion air. A mixing tube may be aligned with flow of the main fuel and combustion air and disposed to promote mixing of the main fuel, combustion air, and flue gas before the mixture reaches the distal flame holder and the distal pilot burner.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Embodiments disclosed herein are directed to devices and methods for improving operation of a combustion system. According to various embodiments disclosed herein, a prefabricated integrated combustion assembly is disclosed that may be installed into a combustion chamber of a combustion system. The combustion system may be a new combustion system that is being assembled or a conventional combustion system that is being retrofitted. The prefabricated integrated combustion assembly includes a mounting flange mountable to a base of the combustion chamber of the combustion system and a fuel nozzle assembly attached to or integrated with the mounting flange. The mounting flange includes a mounting face and a back face. The fuel nozzle assembly includes a fuel nozzle having a tip thereof positioned at a predetermined distance from the mounting face of the mounting flange, and an oxidant outlet. The prefabricated integrated combustion assembly further includes one or more supports attached to or integrated with the mounting flange and extending outward from the mounting face thereof. Additionally, the prefabricated integrated combustion assembly includes a perforated flame holder supported by one or more supports. The perforated flame holder includes a body defining a plurality of apertures. Furthermore, the perforated flame holder is positioned at a predetermined distance from the mounting face of the mounting flange and from the tip of the fuel nozzle.

In some embodiments, the combustion system may exhibit an increased or improved heat transfer therefrom to one or more elements heated thereby. As such, a greater amount of chemical energy stored in a fuel may be converted to heat and transferred to objects and/or materials heated by the retrofitted combustion system. Furthermore, the combustion system may combust the fuel at a lower temperature than a conventional combustion system. Under some operating conditions, by reducing the combustion temperature, the amount of pollutants produced by the retrofitted combustion system also may be reduced (e.g., as compared to the amount of pollutants produced by a conventional combustion system). For example, the combustion system may produce less oxides of nitrogen "$NO_x$" (e.g., NO and/or $NO_2$) than a conventional combustion system (e.g., a system configured to support a conventional diffusion flame). In some embodiments, the combustion system may facilitate a leaner combustion than a conventional combustion system (e.g., the combustion system may sustain a flame from a leaner fuel to oxidant ratio than may be sustained by the conventional combustion system).

Figure 1:
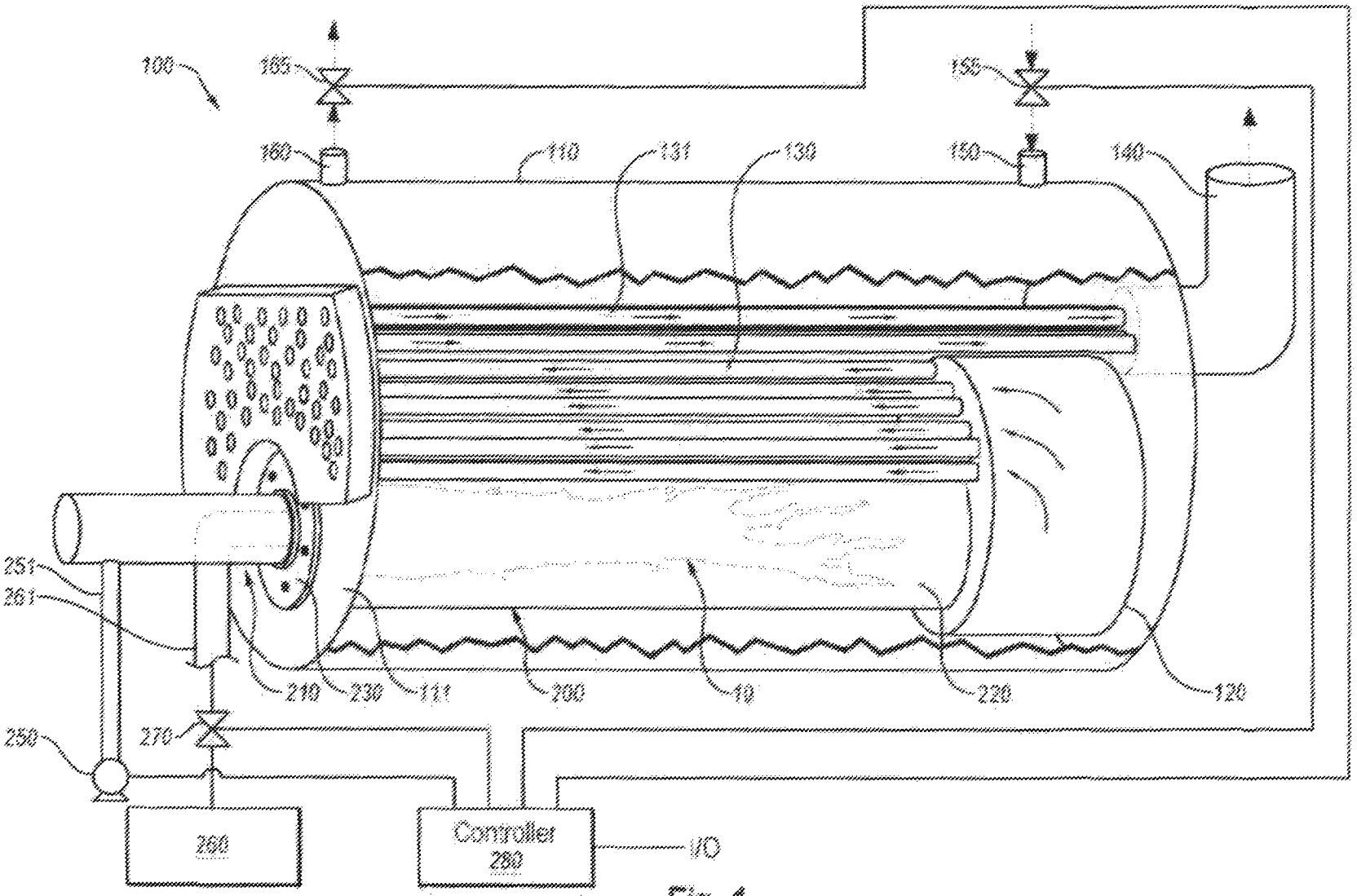
FIG. 1 is an isometric cutaway view of a fire-tube boiler, according to an embodiment.

FIG. 1 is an isometric view of an embodiment of a fire-tube boiler 100 with a cutaway to expose internal elements and components thereof, such as a combustion system 200 at least partially located inside the fire-tube boiler 100, according to an embodiment. Specifically, the combustion system 200 may be positioned inside a shell 110 of the fire-tube boiler 100. The combustion system 200 includes a fuel nozzle assembly 210 that has a fuel nozzle and an oxidant outlet. In particular, the fuel nozzle may inject fuel into a combustion chamber 220 and the oxidant outlet may facilitate flow of and/or force an oxidant into the combustion chamber 220. The fuel and oxidant may mix (e.g., in the combustion chamber 220) and may be ignited and combusted thereafter in the combustion chamber 220. For example, the combustion system 200 may include an ignition device, such as a spark igniter, which may be positioned downstream of the fuel nozzle and oxidant outlet and may ignite the fuel. Ignition and/or combustion of the fuel and oxidant in the combustion chamber 220 may produce a flame 10.

The fuel nozzle assembly 210 may be attached or connected to a mounting flange 230, which may be secured to a base of the combustion system 200 and/or to a base 111 of the shell 110 (e.g., the mounting flange 230 may be bolted to the base of the combustion system 200 and/or to the base 111 of the shell 110). The combustion system 200 may include a blower 250 operably connected to the fuel nozzle assembly 210 (e.g., the blower 250 may be connected to the oxidant outlet), such that the blower 250 may force the oxidant into the combustion chamber 220, and the oxidant together with the fuel and may facilitate combustion thereof. For example, an oxidant line 251 may place the blower into fluid communication with the oxidant outlet of the fuel nozzle assembly 210.

The fuel nozzle of the fuel nozzle assembly 210 may be connected to a fuel supply 260 (e.g., a fuel line 261 may provide fluid communication between the fuel nozzle of the fuel nozzle assembly 210 and the fuel supply 260). The fuel supply 260 may include any number of suitable fuels. For example, the fuel supply 260 may include natural gas, propane, #2 fuel oil, #6 fuel oil, combinations of the foregoing, etc. Furthermore, a fuel valve 270 may be operated to control the amount of fuel injected from the fuel nozzle into the combustion chamber 220 (e.g., the fuel valve 270 may be positioned between the fuel supply 260 and the fuel nozzle).

In some embodiments, a boiler controller 280 may control operation of the blower 250 and/or fuel valve 270. For example, the boiler controller 280 may control the flow of oxidant (e.g., air) forced into the combustion chamber 220 by controlling the operation of the blower 250. By controlling or operating the fuel valve 270, the boiler controller 280 may control the amount and/or velocity of the fuel injected into the combustion chamber 220.

Generally, combustion of the fuel produces flue gas. The temperature of the flue gas may be higher than ambient temperature outside of the fire-tube boiler 100. The flue gas may be channeled from the combustion system 200 into an exhaust plenum 120 and subsequently into fire tubes 130. In the illustrated embodiment, the flue gas flows in the fire tubes 130 from the exhaust plenum 120 toward the base 111 of the shell 110 (e.g., in the direction opposite to the direction of fuel flow in the combustion system 200). It should be appreciated, however, that the fire tubes 130 and the shell 110 of the fire-tube boiler 100 may have any suitable arrangement and the flue gas may flow inside such fire tubes in any suitable direction.

In some embodiments, the fire tubes 130 may be arranged such that the m flue gas may flow in multiple directions relative to the shell 110. In the illustrated embodiment, the fire-tube boiler 100 includes secondary fire tubes 131. Flue gas from the fire tubes 130 may enter the secondary fire tubes 131 and may flow in the direction opposite to the flow of the flue gas in the fire tubes 130. Moreover, the flue gas from the fire tubes 131 may exit the fire-tube boiler 100 out of an exhaust 140. Generally, the flue gasses exiting the exhaust 140 of the fire-tube boiler 100 may include a relatively high level of $NO_x$.

In the illustrated embodiment, the shell 110 is configured to hold water. As mentioned above, the combustion system 200 is positioned inside the shell 110 of the fire-tube boiler 100. Moreover, the fire tubes 130, 131 also may be positioned inside the shell 110. Hence, for example, the water in the shell 110 may at least partially surround the exterior of the combustion chamber 220 of the combustion system 200 and/or exterior of the fire tubes 130, 131. During combustion, the combustion chamber 220 of the combustion system 200 is heated, and the heat is transferred from the combustion chamber 220 to the surrounding water. Furthermore, the flue gas may be generally hotter than the water in the shell 110. Accordingly, the heat from the flue gas may be transferred to the water in the shell 110 (through the fire tubes 130, 131). In any event, heat transferred from the exterior of the combustion chamber 220 and the heat transferred from the fire tubes 130, 131 to the water may increase the temperature thereof.

In the illustrated embodiment, the fire-tube boiler 100 includes at least one water inlet 150 and at least one water/steam outlet 160. Specifically, water may be circulated through the shell 110 such that added water is heated to a suitable temperature, and steam or hot water exits the shell 110 for further use (e.g., to generate power, such as by passing through a turbine, to heat spaces, etc.). The fire-tube boiler 100 also may include at least one inlet valve 155 and at least one outlet valve 165, which may correspondingly control the flow of water into and/or out of the shell 110. For example, the boiler controller 280 may control and/or operate the inlet and/or outlet valves 155, 165 to control the flow of water into and/or out of the shell 110, the temperature of the water in the shell 110, the amount of the water in the shell 110, combinations of the foregoing, etc.

The fire-tube boiler 100 in the illustrated example is generally horizontally oriented and has a generally horizontally oriented combustion system 200. It m should be appreciated that the fire-tube boiler 100 and/or the combustion system 200 thereof may have any number of suitable orientations, which may vary from one example to the next (e.g., the fire-tube boiler 100 and/or the combustion system 200 may have generally vertical orientation). Moreover, the combustion system 200 (or a similar combustion system) may be used in or incorporated into any number of suitable devices and systems for heating one or more objects and/or substances (e.g., in furnaces, water heaters, etc.).

As noted above, the combustion system 200 of the fire-tube boiler 100 may be installed and/or retrofitted with a prefabricated integrated combustion assembly including a perforated flame holder in order to improve the operating efficiency thereof and/or to reduce the amount of pollutants, such as NON, produced thereby. More specifically, in some embodiments, the fuel nozzle assembly 210 may be disconnected from the combustion system 200 and fire-tube boiler 100 and the fuel nozzle assembly 210 may be subsequently removed therefrom. For example, the fuel nozzle assembly 210 may be disconnected from the oxidant line 251 and fuel line 261. Furthermore, as noted above, the fuel nozzle assembly 210 may be connected to or integrated with the mounting flange 230, which may be attached to the base 111 of the shell 110 and/or to the base 240 of the combustion chamber 220. In other embodiments, the fire-tube boiler 100 is not retrofitted, but rather a prefabricated integrated combustion assembly (e.g., prefabricated integrated combustion assembly 300 of FIG. 3) including a perforated flame holder may be installed into the fire-tube boiler 100 during final assembly.

Figure 2:
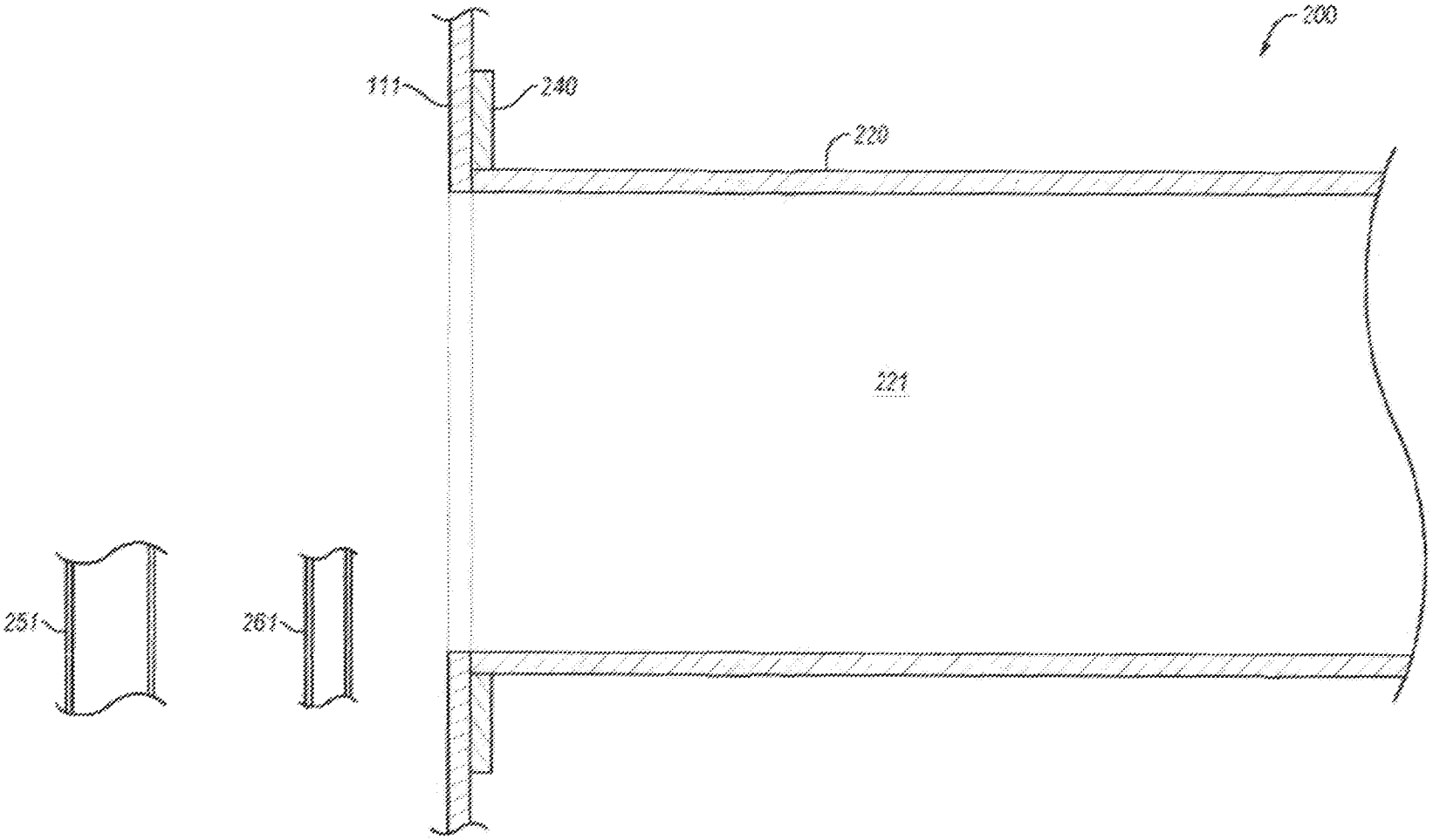
FIG. 2 is a cross-sectional view of a combustion chamber of the fire-tube boiler of FIG. 1, according to an embodiment.

FIG. 2 illustrates a cross-sectional view of the combustion system 200 after the fuel nozzle assembly 210 (FIG. 1) is removed therefrom and/or prior to installation of the prefabricated integrated combustion assembly (e.g., prefabricated integrated combustion assembly 300 of FIG. 3), according to an embodiment. More specifically, in some embodiments, after removal of the fuel nozzle assembly 210 and/or prior to installation of the prefabricated integrated combustion assembly, the base 240 of the combustion chamber 220 may be exposed for attaching the prefabricated integrated combustion assembly according to a number of different embodiments disclosed herein. Likewise, the oxidant line 251 and fuel line 261 may be exposed for connecting to a modified fuel nozzle assembly (of the integrated combustion assembly), as described m below in more detail. In some embodiments, the base 240 may be backed by and/or attached to the base 111 of the shell of the fire-tube boiler. Hence, the integrated combustion assembly may be mounted to the base 111 and/or to the base 240 of the combustion chamber 220.

One or more portions or elements of the integrated combustion assembly may be positioned in and/or extend into an internal volume 221 of the combustion chamber 220. As such, for example, the internal volume 221 of the combustion chamber 220 may have sufficient size to accommodate such portions of the integrated combustion assembly and, vice versa, the integrated combustion assembly may be sufficiently sized and configured to fit into the internal volume 221 of the combustion chamber 220. Accordingly, the combustion system may be retrofitted without removal and/or replacement of the combustion chamber 220 (e.g., the combustion chamber 220 may remain in the shell of the fire-tube boiler). In any event, the integrated combustion assembly may be positioned in the internal volume 221 of the combustion chamber 220 and/or may be mounted or attached to the base 240 of the combustion chamber 220 and/or to the base 111 of the shell 110 of the fire-tube boiler 100. Again, the fire-tube boiler 100 is only an example of a device or system that may include the combustion system 200 or a similar combustion system, which may be retrofitted with the integrated combustion assembly according to one or more embodiments described herein.

Figure 3:
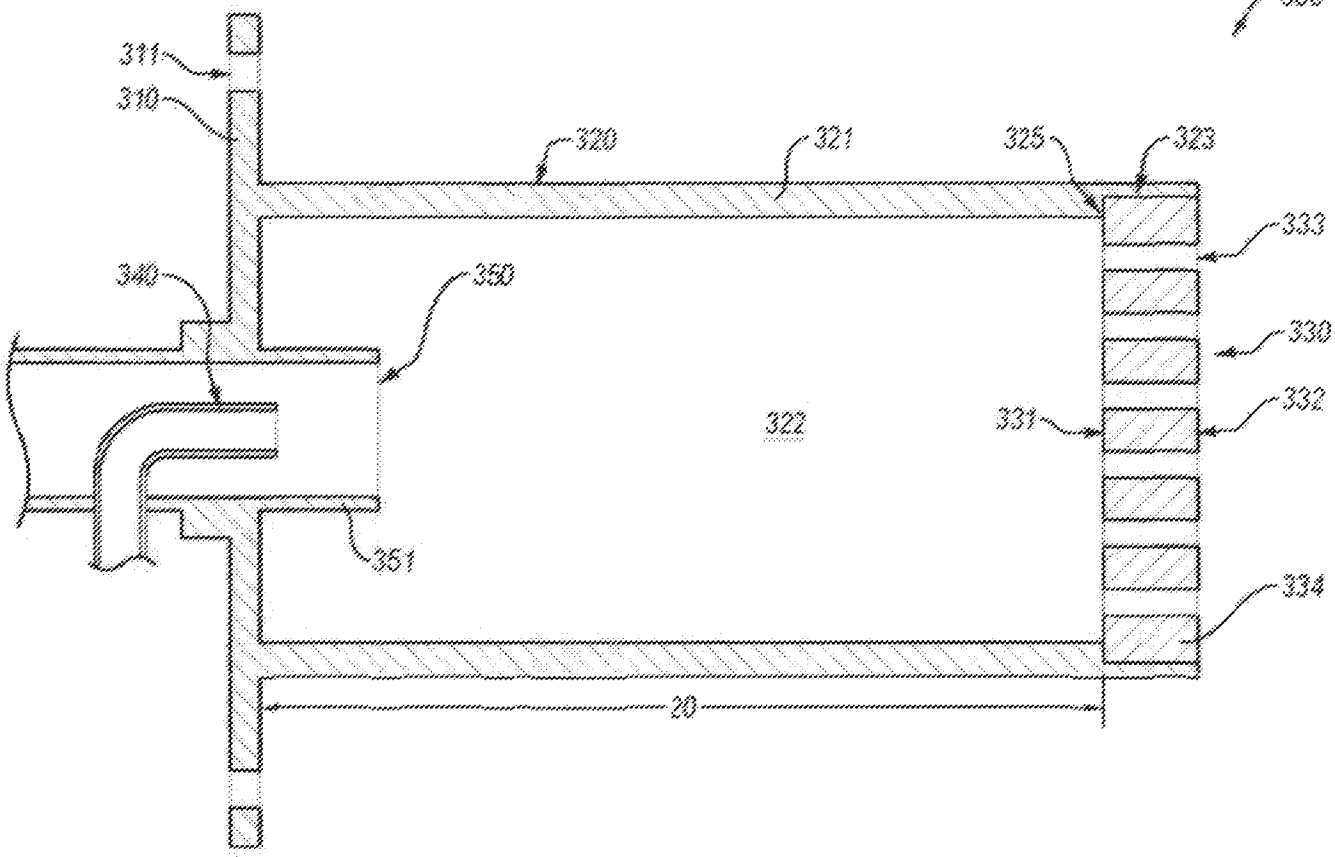
FIG. 3 is a cross-sectional view of a prefabricated integrated combustion assembly, according to an embodiment.

FIG. 3 illustrates a prefabricated integrated combustion assembly 300, according to an embodiment. In at least one embodiment, the integrated combustion assembly 300 includes a mounting flange 310 that may be configured to attach and/or mount to a combustion system. For example, the mounting flange 310 may be attached or mounted to the base of the combustion chamber. Additionally or alternatively, as mentioned above, the mounting flange 310 may be attached or mounted to the base of the fire-tube boiler 100 (e.g., to the base of the shell).

In some embodiments, the mounting flange 310 may include one or more bolt holes 311. For example, one or more fasteners may be inserted through the corresponding bolt holes 311 and may connect the mounting flange 310 (and the integrated combustion assembly 300) to the base of the combustion chamber and/or to the base of the shell of the fire-tube boiler 100. It should be appreciated, however, that the mounting flange 310 and/or integrated combustion assembly 300 may be secured to the base of the combustion chamber and/or the base of the fire-tube boiler 100 (e.g., to the base of the shell of the fire-tube boiler), with any number of suitable mechanisms, as described below in more detail.

In some embodiments, the integrated combustion assembly 300 may include a support 320 that may extend outward from the mounting flange 310. Generally, the support 320 may support a perforated flame holder 330 at a predetermined distance 20 from a mounting face of the mounting flange 310. Additionally or alternatively, the flame holder 330 may be secured to the support 320 at a predetermined orientation relative to the mounting face of the mounting flange 310.

For example, the support 320 may be generally tubular and may be defined by a continuous wall 321 (e.g., the support 320 may have an approximately cylindrical, tubular shape). Additionally or alternatively, the support 320 may have one or more openings therethrough and/or may have an otherwise non-continuous configuration. Moreover, in some embodiments, the support 320 may include multiple circumferentially-spaced supports extending outward from the mounting flange 310. Such supports 320 may also be sized and configured to support the flame holder 330 at the distance 20 from the mounting face of the mounting flange 310.

In one or more embodiments, the mounting flange 310 may be integrated with the support 320. For example, the mounting flange 310 and support 320 may be cast as a solid or integral body and/or may be machined thereafter to final dimensions. For instance, the mounting flange 310 and the support 320 may be cast from aluminum, zinc, iron, high-temperature refractory metal materials, or any number of suitable materials. Moreover, in some embodiments, the mounting flange 310 and the support 320 may be 3-D printed, fabricated using powder metallurgy techniques, or any other suitable manufacturing techniques to fabricate a mounting flange 310 that is substantially monolithic or integrated with the support 320.

The integrated combustion assembly 300 also may include a fuel nozzle 340, which may be configured to inject fuel into a combustion volume 322 that may be at least partially defined by the wall 321 of the support 320. In particular, as described below in more detail, the fuel may be ignited and/or combusted in m the combustion volume 322. To facilitate ignition and/or combustion of the fuel, the integrated combustion assembly 300 may include an oxidant outlet 350 that, in some embodiments, may be defined by a tubular member 351. In particular, the tubular member 351 may lack one or more vortex generating structures (e.g., swirl vanes) and is configured to, at least selectively, cause heat not to be recycled near the fuel nozzle 340, thereby allowing the fuel and oxidant to reach the perforated flame holder 330 prior to ignition of the combustion reaction.

For example, oxidant may flow or may be forced out of the oxidant outlet 350 and into the combustion volume 322. Moreover, the oxidant may mix with the fuel to facilitate the combustion of the fuel and oxidant mixture. In an embodiment, the fuel nozzle 340 may be at least partially positioned within the flow of the oxidant (e.g., upstream from the oxidant outlet 350). As such, for example, as the fuel flows from the fuel nozzle 340 into the combustion volume 322, the fuel may mix with the oxidant flowing and/or being forced out of the oxidant outlet 350. Subsequently, the mixed fuel and oxidant (e.g., air) may be ignited and/or combusted downstream from the fuel nozzle 340 and oxidant outlet 350, as described below in more detail.

In at least one embodiment, the fuel nozzle 340 and/or the oxidant outlet 350 may be integrally formed with the mounting flange 310 and/or support 320. For example, the oxidant outlet 350 may be integrally formed with the mounting flange 310 (e.g., with one or more fabrication methods described above in connection with the mounting flange 310 and the support 320). As mentioned above, the fuel nozzle 340 may be positioned inside the flow of the oxidant, and at least a portion of the fuel nozzle 340 may be positioned upstream from the oxidant outlet 350, such that before flowing out the oxidant outlet 350, the oxidant (e.g., air) may flow around the fuel nozzle 340 and mix with the fuel exiting the fuel nozzle 340.

In an embodiment, the fuel nozzle 340 may be connected to and/or integrally formed with the tubular member 351 that defines the oxidant outlet 350 and with the mounting flange 310. In any event, the tip of the fuel nozzle 340 may be positioned at a predetermined location or distance and/or may have a predetermined orientation relative to the mounting face of the mounting flange 310. As described above, the flame holder 330 may be positioned at the predetermined distance 20 from the mounting face of the mounting flange 310. Accordingly, the flame holder 330 may be positioned at the predetermined distance from the tip of the fuel nozzle 340.

The flame holder 330 may include an upstream side 331 and a downstream side 332. As the fuel and oxidant mixture approaches and/or contacts the flame holder 330 (e.g., the upstream side 331 of the flame holder 330), the fuel and oxidant mixture may be ignited and/or combusted. Furthermore, the flame holder 330 includes a plurality of apertures 333 that may be formed in and/or defined by a body 334 of the flame holder 330. Each or some of the apertures 333 extend from the upstream side 331 to the downstream side 332 completely through the thickness of the body 334. In any event, as the fuel and oxidant mixture ignites and/or combusts at the flame holder 330, at least some of the flame formed thereby may enter the one or more of the apertures 333 in the body 334 of the flame holder 330.

Generally, the flame holder 330 may be formed from or include any number of suitable materials, which may vary from one embodiment to the next. For example, the flame holder 330 may include refractory metal materials, ceramics, high-temperature alloys (e.g., nickel superalloys), etc. Moreover, the apertures 333 of the flame holder 330 may have any suitable shape and/or size (e.g., the apertures 333 may be approximately cylindrical, prismoid, etc.). Similarly, the apertures 333 may be positioned and/or arranged on the body 334 of the flame holder 330 in any number of suitable configurations (e.g., the apertures 333 may have a generally circular arrangement on the body 334 of the flame holder 330). Examples of suitable configurations for the flame holder 330 are disclosed in PCT International Application No. PCT/US2014/016628 filed on 14 Feb. 2014, the disclosure of which is incorporated herein, in its entirety, by this reference.

The flame holder 330 also may have any suitable thickness, shape, size, or combinations thereof. In at least one embodiment, the flame holder 330 may have an approximately cylindrical shape (e.g., the flame holder 330 may have a circular cross-section). For example, the support 320 may surround at least a portion of a lateral periphery of the flame holder 330.

It should be appreciated that the flame holder 330 may be secured or attached to the support 320 with any number of suitable mechanisms and in any number of suitable configurations. In an embodiment, the support 320 may include a shoulder 325, which may position and/or orient the flame holder 330 relative to the mounting face of the mounting flange 310 (e.g., the upstream side 331 may abut and/or may sit on the shoulder 325 of the support 320). Moreover, in an embodiment, the flame holder 330 may be press-fitted into the support 320. For example, the support 320 may include an opening or a pocket 323, which may be sized and configured to accept the flame holder 330 with an interference fit, slip fit, or merely having the flame holder 330 at least partially positioned therein.

In some embodiments, the support 320 may be initially heated (e.g., to a temperature of at least about the operating temperature of the integrated combustion assembly 300 or above such temperature), and the flame holder 330 may be subsequently press-fitted into the pocket 323 of the support 320. Accordingly, as the temperature of the support 320 increases and the support 320 expands, the flame holder 330, which may have a lower coefficient of thermal expansion than the support 320, may remain press-fitted in the pocket 323 of the support 320. Additionally or alternatively, the flame holder 330 may be brazed, welded, or otherwise secured to and/or within the pocket 323 of the support 320.

Because the tip of the fuel nozzle 340 is positioned at the predetermined distance relative to the flame holder 330, the fuel and oxidant mixture exiting the fuel nozzle 340 may be suitably positioned relative to the flame holder 330. For example, the flame holder 330 may be positioned at or about at a centroid of or a terminal end of the flame or flame radiation that may be produced from the ignition of the fuel and oxidant mixture in the absence of the flame holder 330. In other words, the flame produced in the absence of the flame holder 330 may extend from a first downstream position to a second downstream position, and the flame holder 330 (when secured to the support 320) may be positioned approximately midway between the first and second positions or at or near the terminal tip of the flame. Moreover, mounting the integrated combustion assembly 300 in the combustion system (as described above) may position the fuel nozzle 340 and the flame holder 330 at predetermined relative positions and orientations relative to each other within the combustion chamber of the combustion system.

While the combustion system shown in FIG. 1 is configured as a fire-tube boiler 100 that is not particularly sensitive to radiant heat transfer, other types of combustions systems are relatively more sensitive to radiation heat transfer. For example, a steam tube boiler, which is typically used for very large systems such as electric power generation, includes a radiation heat transfer section for producing superheat in the steam. Locating the perforated flame holder 330 at or near the centroid of the flame may be beneficial in a steam tube boiler or other combustion systems that are relatively more sensitive to radiation heat transfer than a fire-tube boiler 100.

During the installation process, an installer/system integrator may insert the integrated combustion assembly 300 into the combustion system. In some embodiments, because the tip of the fuel nozzle 340 is positioned at the predetermined distance from the flame holder 330 and at a predetermined orientation relative thereto, the integrated combustion assembly 300 may be incorporated into the combustion system without further adjustments to the relative position and/or orientation of the flame holder 330 and fuel nozzle 340. Accordingly, the integrated combustion assembly 300 may increase a speed of retrofitting and/or final assembly of the combustion system, reduce errors (which may be potentially dangerous during the operation of the combustion system), and improve performance of the combustion system.

In any event, the flame produced during combustion of the fuel and oxidant mixture at or near the flame holder 330, may be at least partially anchored to the flame holder 330. Accordingly, heat from the flame may be transferred to the flame holder 330, thereby lowering combustion temperature and/or the flame temperature. Moreover, lowering combustion and/or flame temperature may reduce $NO_x$ produced during combustion of the fuel and oxidant mixture. As such, under some operating conditions, the retrofitted combustion system may exhibit a lower $NO_x$ production and/or higher operating efficiency.

Figure 4:
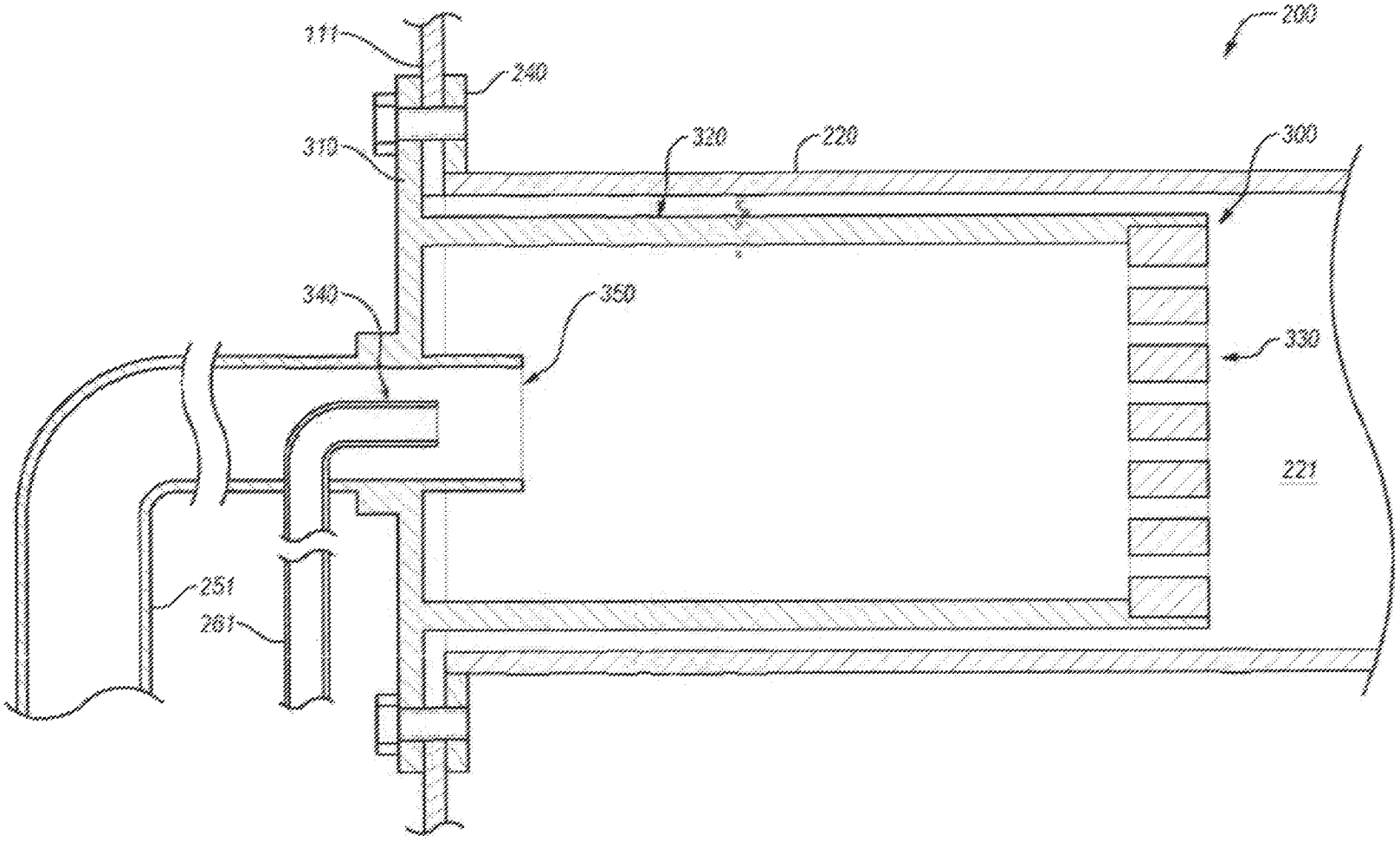
FIG. 4 is a cross-sectional view of the combustion chamber of FIG. 2 with the integrated combustion assembly of FIG. 3 installed therein, according to an embodiment.

FIG. 4 illustrates the integrated combustion assembly 300 retrofitted into the combustion system 200, according to an embodiment. In particular, the fuel nozzle 340 may be connected to the fuel line 261, which may supply fuel to the fuel nozzle 340, and the oxidant outlet 350 may be connected to the oxidant line 251, which may supply oxidant, such as air, to the oxidant outlet 350. Moreover, the mounting flange 310 may be attached or mounted to the base 111 of the shell m 110 of fire-tube boiler 100, such that the support 320 together with the flame holder 330 are positioned inside the internal volume 221 of the combustion chamber 220.

In the illustrated embodiment, the mounting flange 310 is secured to the base 111 with mounting screws. As noted above, however, the mounting flange 310 may be secured to the base 111 and/or to the base 240 in any suitable manner. For example, one or more tabs or clamps may clamp down and/or secure the mounting flange 310 to the base 111 and/or base 240. Additionally or alternatively, the mounting flange 310 may be welded, brazed, or otherwise permanently or semi-permanently attached to the base 111 and/or to the base 240. Examples of suitable attachments further include one or more channels that may secure the mounting flange 310 to the one base 111 and/or to the base 240, backing plates that may clamp down and secure the mounting flange 310 to the base 111 and/or to the base 240, combinations of the foregoing, or other suitable attachment mechanisms.

Figure 5:
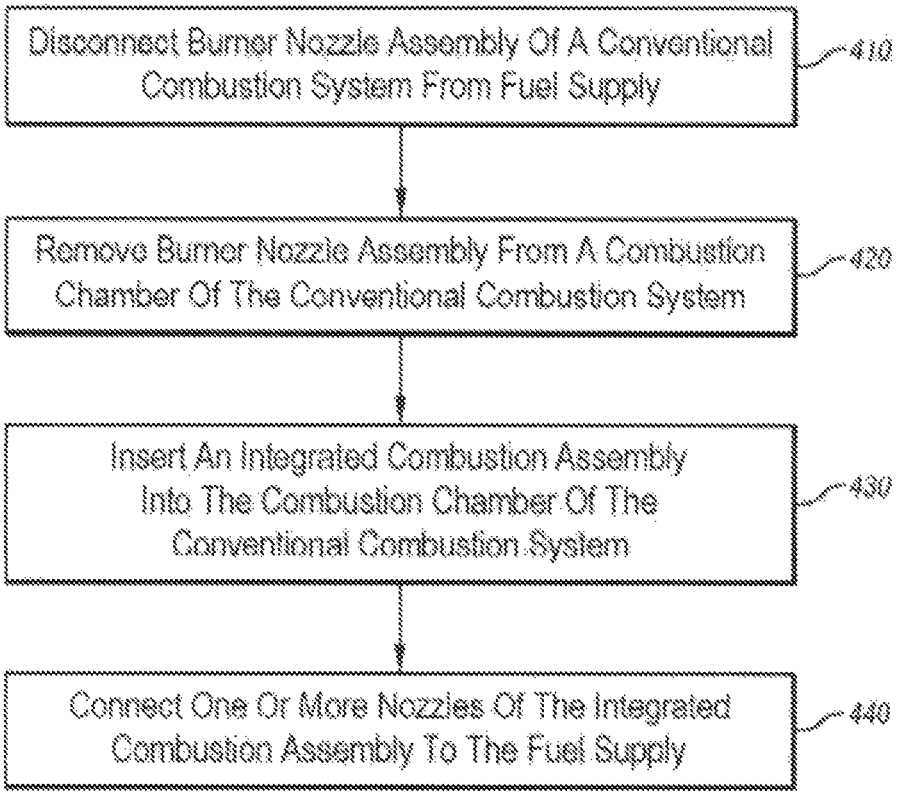
FIG. 5 is a flowchart of a method for installing a prefabricated integrated combustion assembly into a combustion system, according to an embodiment.

Generally, the combustion system may be retrofitted and/or finally assembled with the integrated combustion assembly 300 in any suitable manner. FIG. 5 illustrates a flow chart of a method for retrofitting the combustion system 200 (FIG. 2) with an integrated combustion assembly, according to an embodiment (e.g., any of the integrated assemblies described herein may be integrated into the combustion system 200 or other type of conventional combustion system). In particular, in some embodiments, retrofitting a conventional burner with an integrated combustion assembly may include an act 410 of disconnecting an existing burner nozzle assembly (e.g., fuel nozzle assembly) of the conventional combustion system from the fuel supply.

In at least one embodiment, retrofitting the conventional combustion system also may include an act 420 of removing the burner nozzle assembly from a combustion chamber of the conventional combustion system. As mentioned above, after the burner nozzle assembly (e.g., fuel nozzle assembly) is removed from the conventional combustion system, the integrated combustion assembly may be incorporated into the combustion chamber. For example, retrofitting may include an act 430 of inserting an integrated combustion assembly into the combustion chamber of the conventional combustion system. Retrofitting also may include an act 440 of connecting one or more nozzles of the integrated combustion assembly to the fuel supply. It should be appreciated that, while the acts for retrofitting a conventional combustion system are described in a particular order, the acts may be performed in any suitable order. Furthermore, as previously noted, in some embodiments, the combustion system is not conventional and is not retrofitted. Instead, in such embodiments, the integrated combustion assembly is inserted into the combustion chamber in the process of final assembly of a new combustion system.

Figure 6:
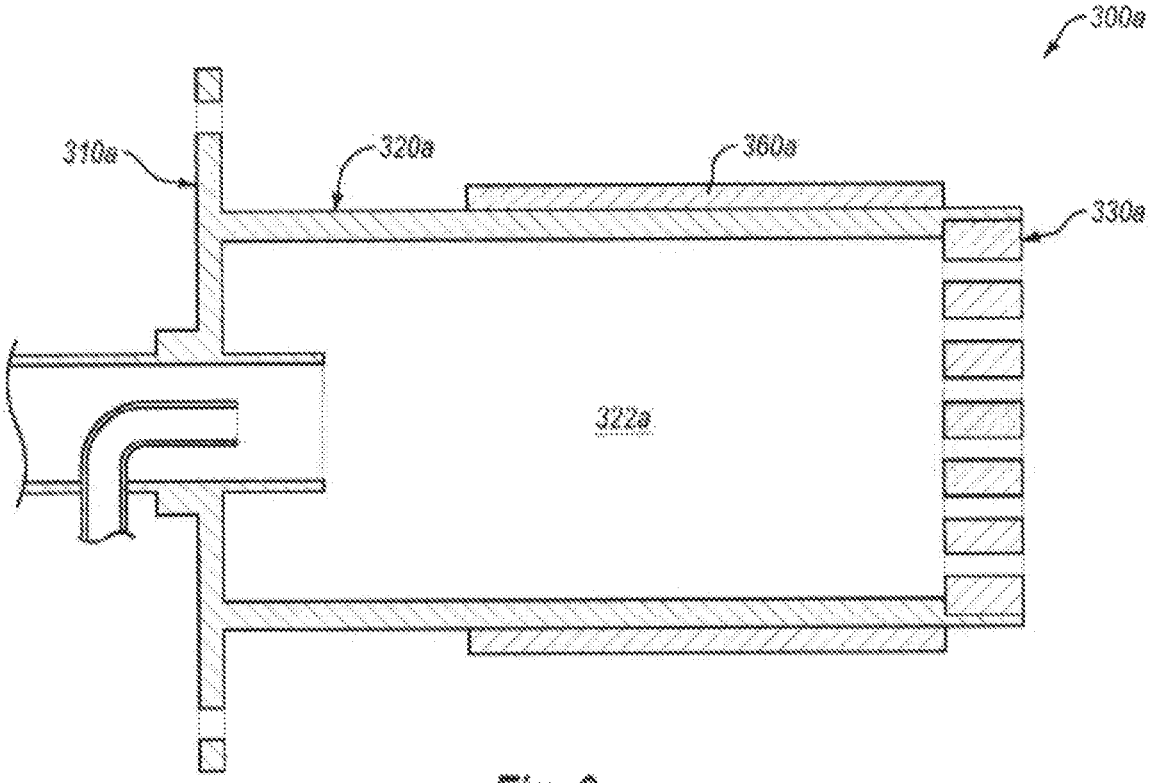
FIGS. 6-9 are cross-sectional views of different prefabricated integrated combustion assemblies, according to various embodiments.

As previously discussed, the integrated combustion assembly may vary from one embodiment to the next. FIG. 6 illustrates an integrated combustion assembly 300*a*, according to an embodiment. Except as otherwise described herein, the integrated combustion assembly 300*a* and its elements and components may be similar to or the same as the integrated combustion assembly 300 (FIG. 3) and its respective elements and components. For example, the integrated combustion assembly 300*a* may include a mounting flange 310*a* and a support 320*a* extending therefrom and securing a flame holder 330*a*, which may be the same as the mounting flange 310, support 320, and flame holder 330 (FIG. 3). In an embodiment, the integrated combustion assembly 300*a* may include insulation 360*a*, which may at least partially wrap around the support 320*a*.

In particular, the insulation 360*a* may prevent or limit radial heat transfer from the perforated flame holder 330*a*, such that the heat transferred from the flame to the flame holder 330*a* is concentrated at the flame holder 330*a* to maintain a fuel ignition temperature within the flame holder 330*a*. In other words, for example, the insulation 360*a* may limit the radiant heat transfer from the support 320*a* to the combustion chamber. In some embodiments, the majority of heat transfer from the flame in a combustion volume 322*a* of the support 320*a* may be to the flame holder 330*a*. As such, in at least one embodiment, a majority of the heat transfer from the flame to the combustion chamber, and subsequently to the water heated thereby, may be radiant heat transfer from the flame holder 330*a* to the walls of the combustion chamber.

Figure 7:
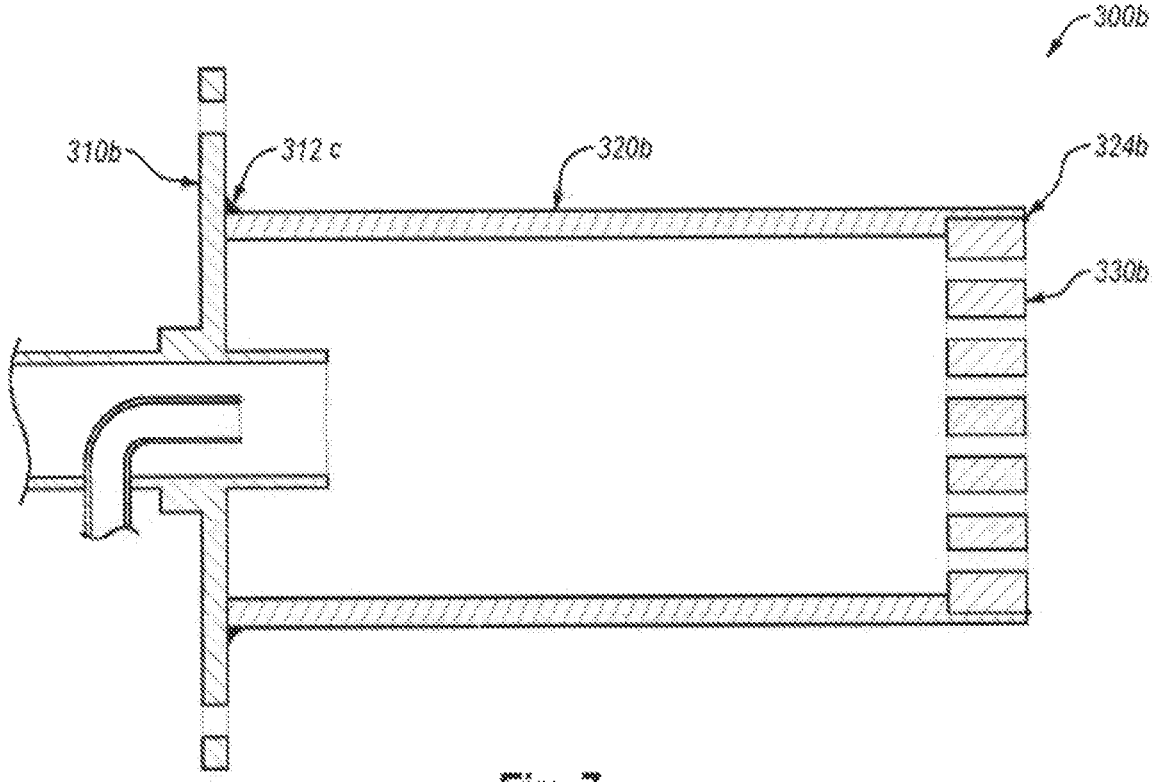

As described above, in some embodiments, the mounting flange, one or more supports, the fuel nozzle, the oxidant outlet 350, or combinations thereof may be integrally formed. Alternatively, two or more of these elements may be connected or fastened together. FIG. 7 illustrates an integrated combustion m assembly 300*b*, according to an embodiment. Except as otherwise described herein, the integrated combustion assembly 300*b* and its elements and components may be similar to or the same as any of the integrated combustion assemblies 300, 300*a* (FIGS. 3 and 6) and their respective elements and components. For example, the integrated combustion assembly 300*b* may include mounting flange 310*b* and support 320*b* connected together, which may be similar to the mounting flange 310*a* and support 320*a* (FIG. 6). In the illustrated embodiment, the mounting flange 310*b* and the support 320*b* are welded together. For example, a weld 312*b* (e.g., a fillet weld) may connect the support 320*b* to the mounting flange 310*b* on the mounting side of the mounting flange 310*b*.

In some embodiments, the mounting flange 310*b* and the support 320*b* may be formed from or include the same material (e.g., the mounting flange 310*b* and support 320*b* may comprise stainless steel). Alternatively or additionally, the mounting flange 310*b* and support 320*b* may include a different combination of weldable materials (e.g., the mounting flange 310*b* may include carbon steel and the support 320*b* may include stainless steel). It should be appreciated that, as mentioned above, the integrated combustion assembly 300*b* may include multiple supports 320*b*. As such, one or some of the supports 320*b* may be formed from or include the same material as the mounting flange 310*b*, and one or some of the supports 320*b* may include or comprise a different material than the mounting flange 310*b*. Moreover, in some embodiments, the support(s) 320*b* may be fastened, brazed, or otherwise secured to the mounting flange 310*b*.

In one or more embodiments, a flame holder 330*b* of the integrated combustion assembly 300*b* may be brazed to the support 320*b*. In particular, for example, a braze joint 324*b* may secure the flame holder 330*b* to the support 320*b*. Generally, the weld material for the weld 312*b* and the braze material for the braze joint 324*b* may be selected from any suitable materials, which may vary from one embodiment to the next. It should be appreciated that brazing involves using a material different from one or more of the elements connected thereby and/or which may be melted at a temperature lower than the melting temperatures of the elements connected thereby. In any event, the weld material for the weld 312*b* and the braze material for the braze joint 324*b* may be selected from any suitable material that may respectively secure the mounting flange 310*b* m to the support 320*b* and the flame holder 330*b* to the support 320*b*, such that the mounting flange 310*b* and support 320*b*, as well as the flame holder 330*b* and support 320*b* remain secured together during the operation of the integrated combustion assembly 300*b* as well as while retrofitting of and/or final assembly of the combustion system.

Figure 8:
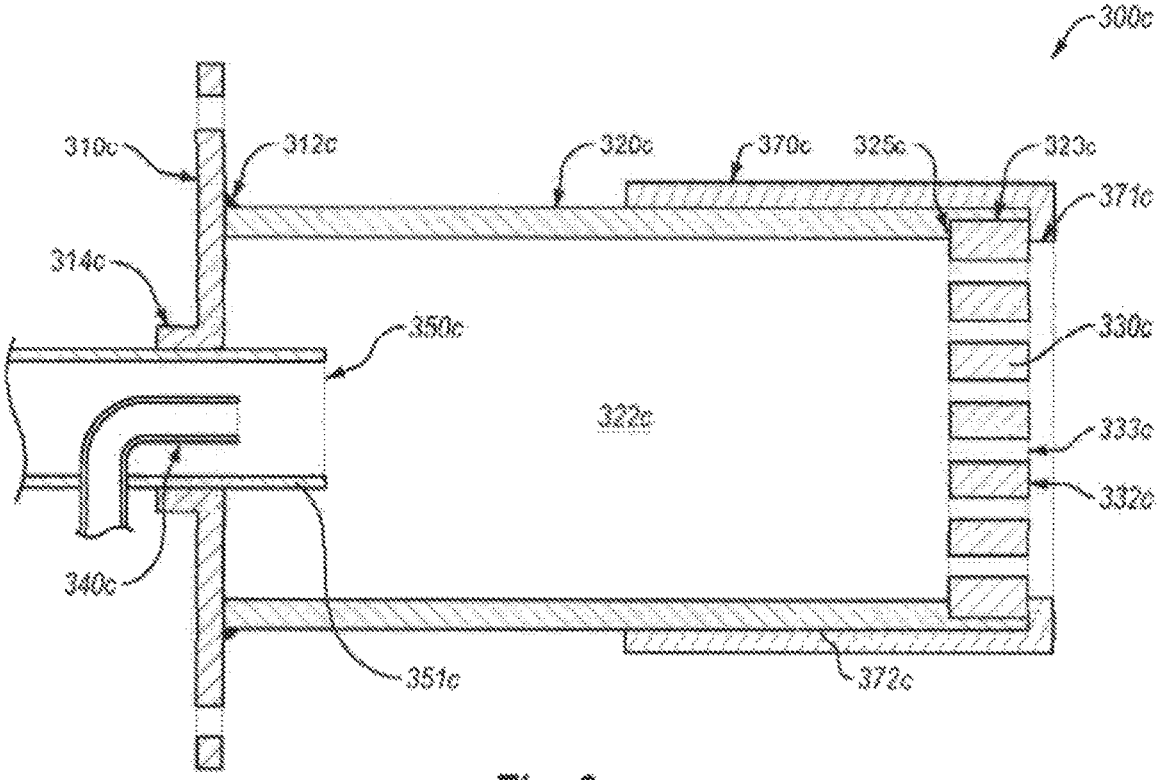

As described above, the flame holder may be connected or attached to one or more supports with any number of suitable mechanisms. FIG. 8 illustrates an integrated combustion assembly 300*c*, according to an embodiment. In particular, in the illustrated example, the integrated combustion assembly 300*c* includes a cap 370*c* that secures a flame holder 330*c* to a support 320*c* of the integrated combustion assembly 300*c*. Except as otherwise described herein, the integrated combustion assembly 300*c* and its elements and components may be similar to or the same as any of the integrated combustion assemblies 300, 300*a*, 300*b* (FIGS. 3, 6, and 7) and their respective elements and components. For example, the flame holder 330*c* may be positioned in a pocket 323*c* of the support 320*c*, and the cap 370*c* may press the flame holder 330*c* against a shoulder 325*c* of the support 320*c*, thereby securing together the support 320*c* and the flame holder 330*c*.

In an embodiment, the cap 370*c* may be secured to the support 320*c*. For example, the cap 370*c* may be press-fitted over the support 320*c*. Additionally or alternatively, the cap 370*c* may be welded or brazed to the support 320*c*. In some embodiments, the cap 370*c* may include multiple portions that may be assembled together about the support 320*c* and may be fastened together in a manner that secures the cap 370*c* to the support 320*c*. In any case, the cap 370*c* may be secured to the support 320*c* with any number of suitable mechanisms, which may vary from one embodiment to the next.

In some embodiments, the cap 370*c* may include an opening 371*c* that may be configured such that apertures 333*c* of the flame holder 330*c* are generally unobstructed by the cap 370*c*. Moreover, the cap 370*c* may include peripheral walls 372*c* that may wrap around at least a portion of the support 320*c*. For example, the peripheral walls 372*c* may extend along the support 320*c* (e.g., an inward facing surface of the cap 370*c* may be in contact with a peripheral or outward facing surface of the support 320*c*).

Generally, the cap 370*c* may extend along any suitable portion of the support 320*c*. For example, the cap 370*c* may extend along the support 320*c* approximately halfway between a downstream side 332*c* of the flame holder 330*c* and a mounting surface of the mounting flange 310*c*. In alternative or additional embodiments, the cap 370*c* may extend farther toward or to the mounting surface of the mounting flange 310*c*.

As described above, the support 320*c* may be welded to the mounting flange 310*c* via a weld 312*c*. In additional or alternative embodiments, the cap 370*c* may extend to the mounting surface of the mounting flange 310*c* and may be welded thereto. More specifically, for example, the support 320*c* and the cap 370*c* may be welded to the mounting flange 310*c* and/or may be welded together. In at least one embodiment, the cap 370*c* may be welded to the mounting flange 310*c*, while the support 320*c* may remain otherwise detached from the mounting flange 310*c*. As such, the cap 370*c* may secure the support 320*c* and the flame holder 330*c* together and secure the support 320*c* to the mounting flange 310*c*.

As mentioned above, a portion of the peripheral surface of the support 320*c* may be insulated, such as to reduce infrared or radiant heat transmission from the support 320*c* to the wall of the combustion chamber. In some embodiments, at least a portion of the cap 370*c* may include insulating material that may provide sufficient insulation to reduce or prevent radiant heat transfer from the support 320*c* to wall of the combustion chamber. As noted above, reducing heat transfer from the support 320*c* to the wall of the combustion chamber may focus the heat transfer from the flame to the flame holder 330*c*, and flame holder 330*c* may radiate heat toward or to the wall(s) of the combustion chamber.

In some embodiments, an oxidant outlet 350*c* of the integrated combustion assembly 300*c* may extend into a combustion volume 322*c* (e.g., the oxidant outlet 350*c* may be defined by a tubular member 351*c* that may have a substantially smooth interior or may have one or more fins or baffles to alter the flow of oxidant and/or fuel therethrough). In some embodiments, the oxidant outlet 350*c* and/or the fuel nozzle 340*c* may be connected to the mounting flange 310*c*. For example, the oxidant outlet 350*c* and/or fuel nozzle 340*c* may be m press-fitted into an opening in the mounting flange 310*c*. Alternatively, the oxidant outlet 350*c* and/or fuel nozzle 340*c* may be positioned inside an opening in the mounting flange 310*c* and may be welded, brazed, fastened, or otherwise attached to the mounting flange 310*c*. As described above, the fuel nozzle 340*c* may be positioned inside the oxidant outlet 350*c* and may be connected thereto. As such, in some instances, connecting or attaching the oxidant outlet 350*c* to the mounting flange 310*c* may correspondingly connect the fuel nozzle 340*c* to the mounting flange 310*c*. In an embodiment, the oxidant outlet 350*c* may be integrally formed with the mounting flange 310*c*.

In an embodiment, the mounting flange 310*c* may include a standoff 314*c* that may extend out and away from the combustion volume 322*c* (e.g., the standoff 314*c* may extend outward from a back surface of the mounting flange 310*c*). For example, the oxidant outlet 350*c* may be press-fitted in the standoff 314*c*, which may provide sufficient surface area for press-fitting the oxidant outlet 350*c* in a manner that sufficiently secures the oxidant outlet 350*c* to the mounting flange 310*c*. Additionally or alternatively, the oxidant outlet 350*c* may be welded to the standoff 314*c* (e.g., a weld may be positioned between or at the outer surface of the tubular member 351*c* and an edge of the standoff 314*c*).

In some embodiments, the integrated combustion assembly may include an integrated ignition mechanism. Furthermore, the integrated combustion assembly may be preassembled with a combustion controller, which may at least partially control operation of the integrated combustion assembly. For example, the combustion controller may cooperate with a controller (e.g., boiler controller 280 of FIG. 1) of the fire-tube boiler to control combustion in the integrated combustion assembly.

Figure 9:
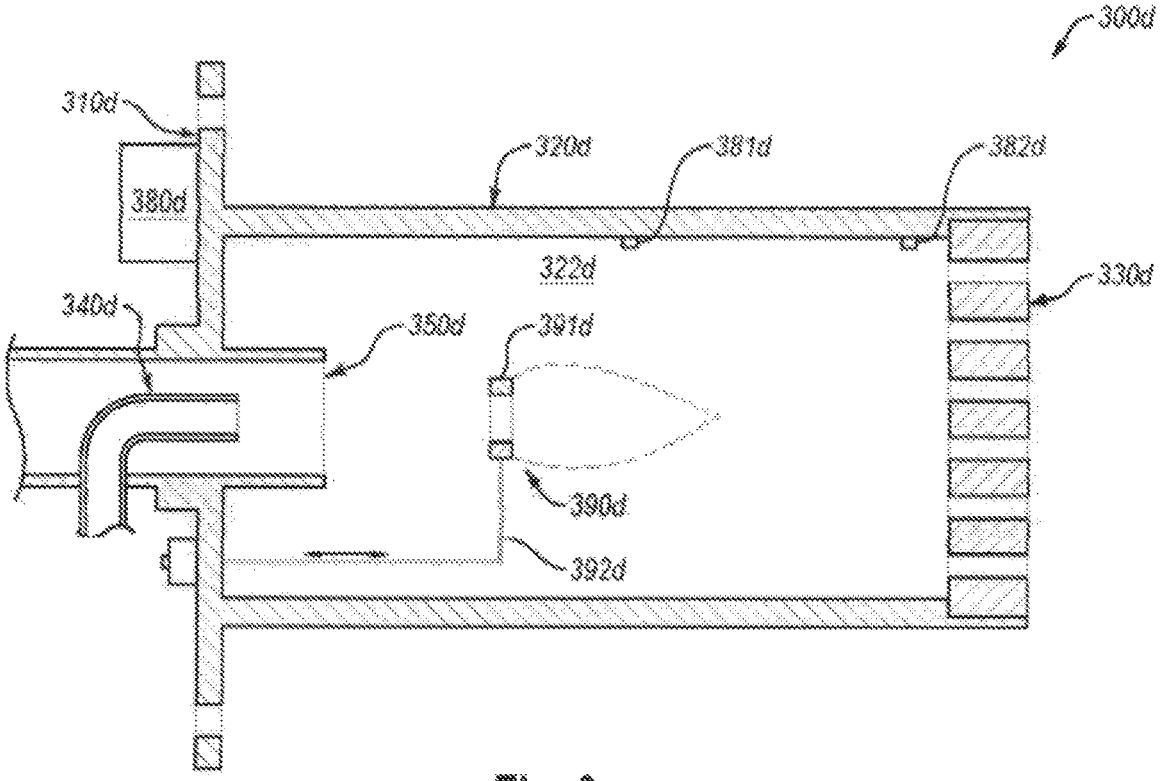

FIG. 9 illustrates an integrated combustion assembly 300*d* that includes a combustion controller 380*d* and ignition assembly 390*d*, according to an embodiment. For example, the combustion controller 380*d* may be mounted to a mounting flange 310*d* or other component of the integrated combustion assembly 300*d*, such as a fuel nozzle assembly. Except as otherwise described herein, the integrated combustion assembly 300*d* and its elements and components may be similar to or the same as any of the integrated combustion assemblies 300, 300*a*, 300*b*, 300*c* (FIGS. 3 and 6-8) and their respective elements and components.

In an embodiment, in operation, the combustion controller 380*d* may receive signals or input from one or more sensors, such as one or more ultraviolet ("UV") sensors 381*d* and/or one or more infrared sensors 382*d*. For example, the UV sensors 381*d* may detect a presence of a combustion byproduct, such as NON, and the infrared sensors 382*d* may measure a temperature of the combustion volume 322*d*. The UV and/or infrared sensors 381*d*, 382*d* may transmit one or more signals responsive to detecting the presence of the combustion byproduct and/or the temperature of the combustion volume 322*d*, respectively. In some embodiments, the combustion controller 380*d* may adjust or modify the flow of fuel and/or oxidant out of the respective fuel nozzle 340*d* and oxidant outlet 350*d* to adjust the combustion of the fuel and oxidant mixture and/or the flame produced thereby in response to receiving the one or more signals transmitted by the UV and/or infrared sensors 381*d*, 382*d*. For example, the combustion controller 380*d* may, independently or in cooperation with the boiler controller, control and/or operate a fuel valve (e.g., fuel valve 270 of FIG. 1) and/or a blower (e.g., blower 250 of FIG. 1) to control the fuel and/or oxidant flow out of the fuel nozzle 340*d* and oxidant outlet 350*d*. Additionally or alternatively, the combustion controller 380*d* may control operation of the ignition assembly 390*d*, as described below in more detail.

In some embodiments, at least partially based on the signals from the UV sensor(s) 381*d*, the combustion controller 380*d* may determine and/or estimate the amount of NO produced during combustion and may adjust the flame accordingly. For example, the combustion controller 380*d* may reduce the amount of fuel and/or increase the amount of oxidant flowing into the combustion volume 322*d*, to produce a leaner burn that may generate less NON. In additional or alternative embodiments, the combustion controller 380*d* may receive signals from the infrared sensor(s) 382*d* that may be related to the temperature of a flame holder 330*d* of the integrated combustion assembly 300*d*. For example, the combustion controller 380*d* may adjust the combustion of the fuel and oxidant mixture and/or the flame produced thereby at least partially based on the temperature of the flame holder 330*d* (e.g., the combustion controller 380*d* may reduce the amount of fuel flowing into the combustion volume 322*d* to reduce the temperature of the flame holder 330*d* or increase the amount of fuel to increase the temperature of the flame holder 330*d*, such as to achieve a suitable and/or predetermined temperature).

During or after installation of the integrated combustion assembly, a fuel line (e.g., fuel line 261 of FIGS. 1-2) is operably coupled to the fuel nozzle 340*d*, an oxidant source or a blower is operably coupled to the oxidant outlet 350*d*, and the combustion controller 380*d* is operably coupled to the boiler controller.

As noted above, the combustion controller 380*d* may cooperate or interface with the boiler controller to control the combustion in the combustion volume 322*d*. For example, signals from the boiler controller may be received at the combustion controller 380*d* (e.g., signals related to a desired or suitable heat output). Moreover, the combustion controller 380*d* may be coupled to the fuel valve and/or the blower, such as to control respective flows of fuel and oxidant into the combustion volume 322*d*. Hence, the combustion controller 380*d* may operate (directly or indirectly) the fuel valve and/or the blower based on the signals from the UV sensor(s) 381*d*, from the infrared sensor(s) 382*d*, from the boiler controller, or combinations thereof. For instance, controlling the fuel valve and the blower may produce a suitable and/or desired combustion and/or heat output.

As mentioned above, in an embodiment, the integrated combustion assembly 300*d* includes the ignition assembly 390*d*. For example, the ignition assembly 390*d* may include an annular holder 391*d* connected to an actuator arm 392*d*. Under some operating conditions, the actuator arm 392*d* may position the ignition assembly 390*d* at a location within the fuel and/or oxidant flow that is suitable for initially anchoring the flame in a manner that preheats the flame holder 330*d* (e.g., to a temperature of at least the auto-ignition temperature of the fuel and oxidant mixture injected into the combustion volume 322*d*). In some embodiments, the ignition assembly 390*d* may include an ignition mechanism. For example, the ignition mechanism may include a spark igniter, a heating element that may raise the temperature of the annular holder 391*d* to at least the auto-ignition temperature of the fuel and oxidant mixture, other suitable ignition mechanisms, and combinations of the foregoing.

In one or more embodiments, the actuator arm 392*d* may be adjustable relative to the fuel nozzle 340*d* and flame holder 330*d*. For example, the combustion controller 380*d* may control the position of the annular holder 391*d* relative to the flame holder 330*d* to anchor and/or advance the flame in the combustion volume 322*d* toward the flame holder 330*d* in a manner that initially raises the temperature of the flame holder 330*d* to an operating temperature thereof (e.g., at least auto-ignition temperature of the fuel and oxidant mixture). In some embodiments, the temperature of the flame holder 330*d* may be initially increased to a suitable operating temperature, and subsequently the ignition assembly 390*d* may be operated to move the annular holder 391*d* away from the fuel and oxidant flow. As such, the fuel and oxidant mixture may flow toward and/or to the flame holder 330*d* and may be ignited and/or anchored thereby. For example, the actuator arm 392*d* may be rotated or pivoted relative to the fuel nozzle 340*d* such that the annular holder 391*d* moves away from the stream of fuel entering and/or flowing in the combustion volume 322*d*. It should be appreciated that the flame may be anchored at a suitable location relative to the flame holder 330*d* with any number of suitable mechanisms. Moreover, in some embodiments, the flame holder 330*d* may be initially preheated (e.g., by a heating element), such that the initial combustion occurs at the flame holder 330*d*, which may also anchor the flame, as described above.

In other embodiments, the flame holder 330*d* may be preheated using electrical resistance heating. For example, a suitable wire may be threaded through apertures of the flame holder 330*d* and heat the flame holder 330*d* as electrical current passes through the wire.

Figure 10:
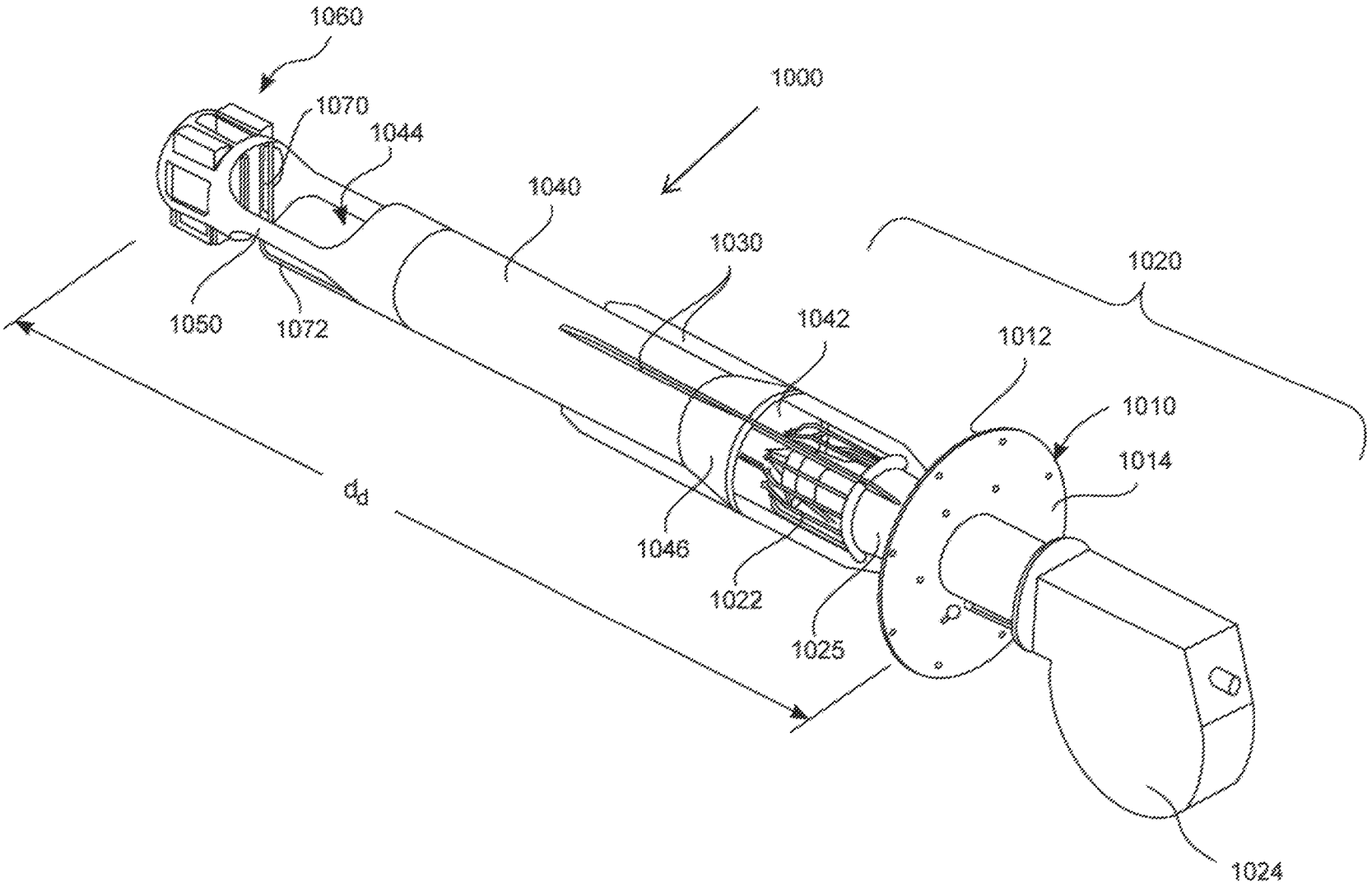
FIG. 10 is a perspective view of an integrated combustion assembly according to an embodiment.
Figure 11:
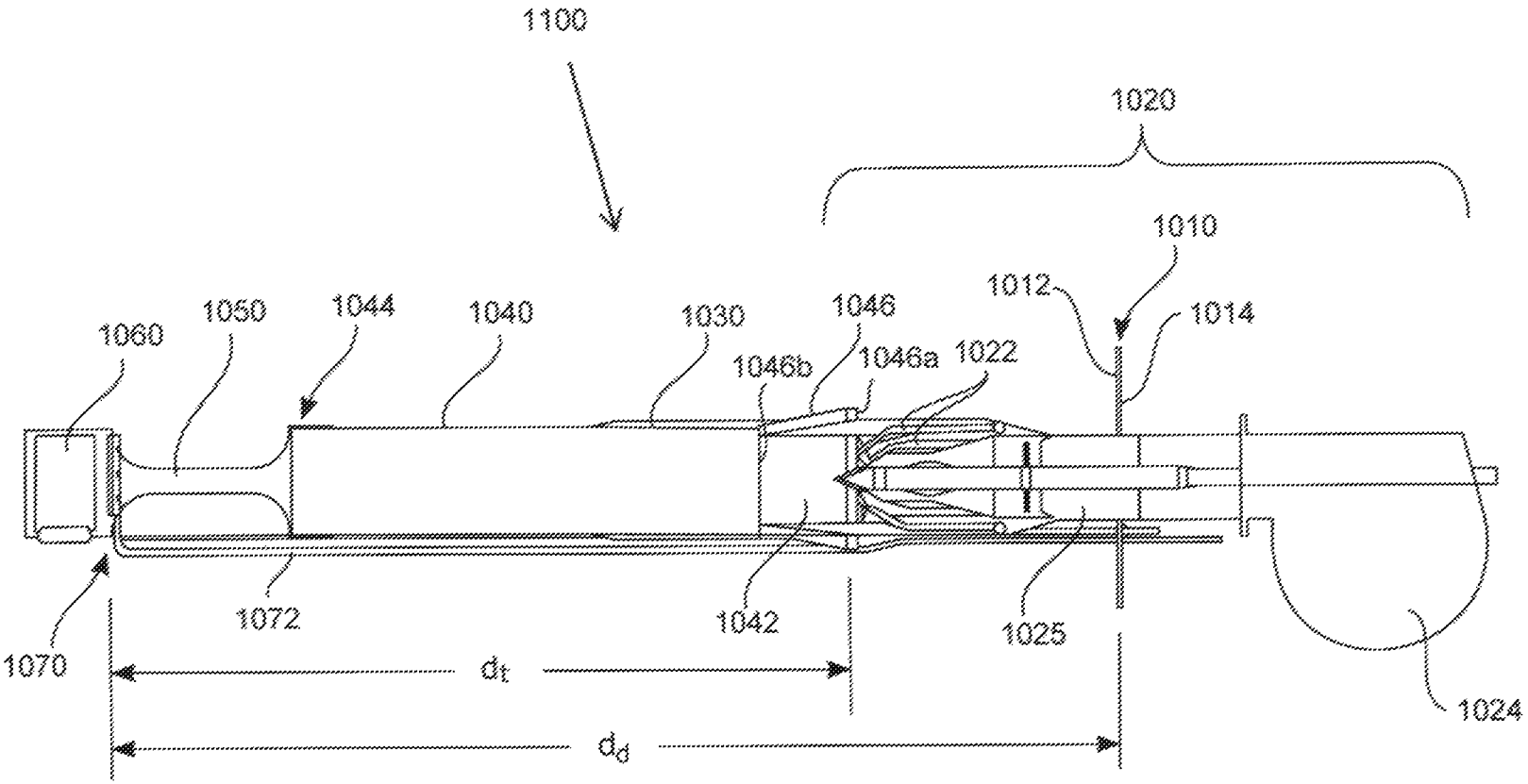
FIG. 11 is a side cutaway view of an integrated combustion assembly, according to an embodiment.
Figure 12:
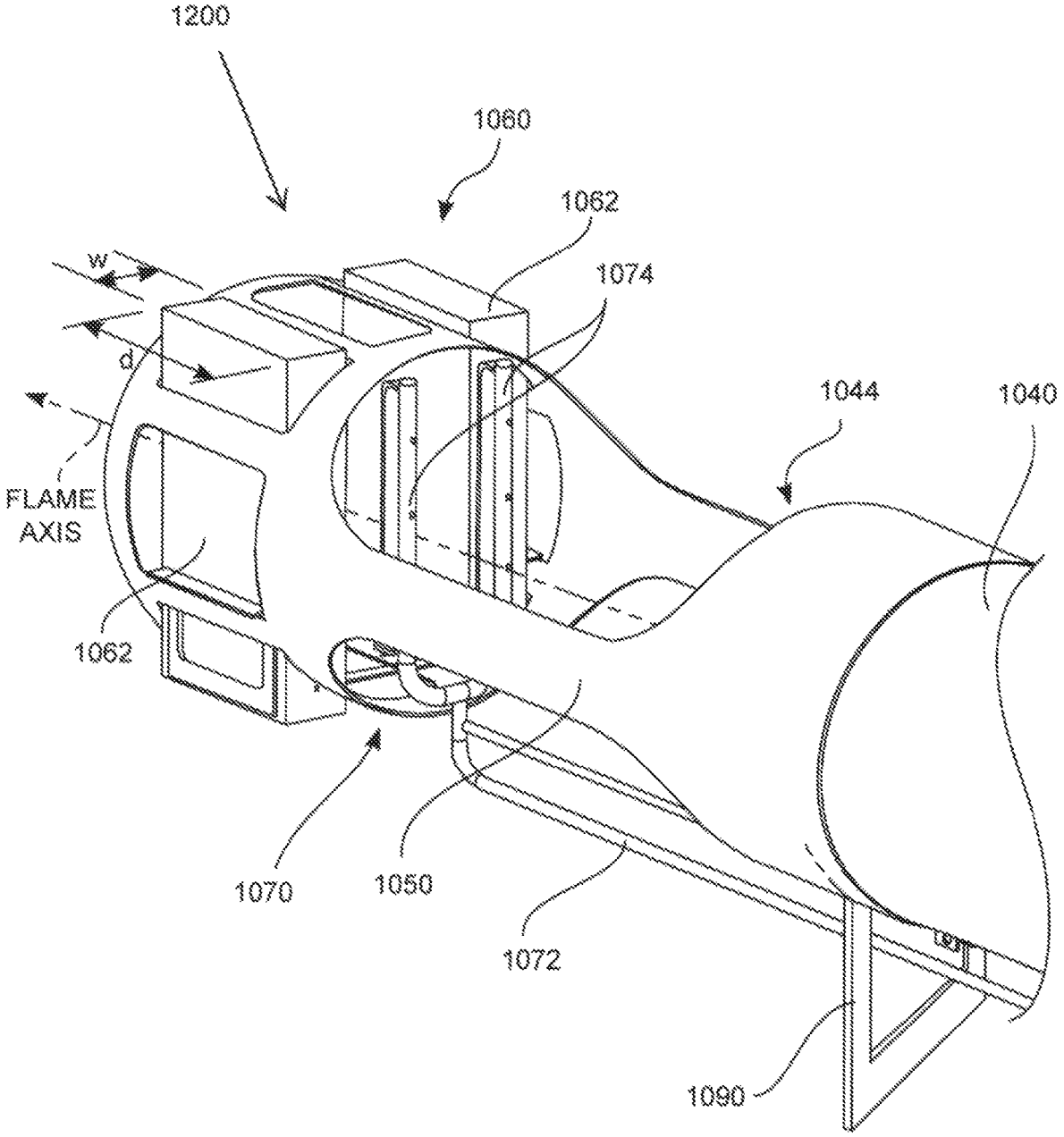
FIG. 12 is a partial view of the distal end of an integrated combustion assembly, including a distal flame holder and pilot burner, according to an embodiment.
Figure 13:
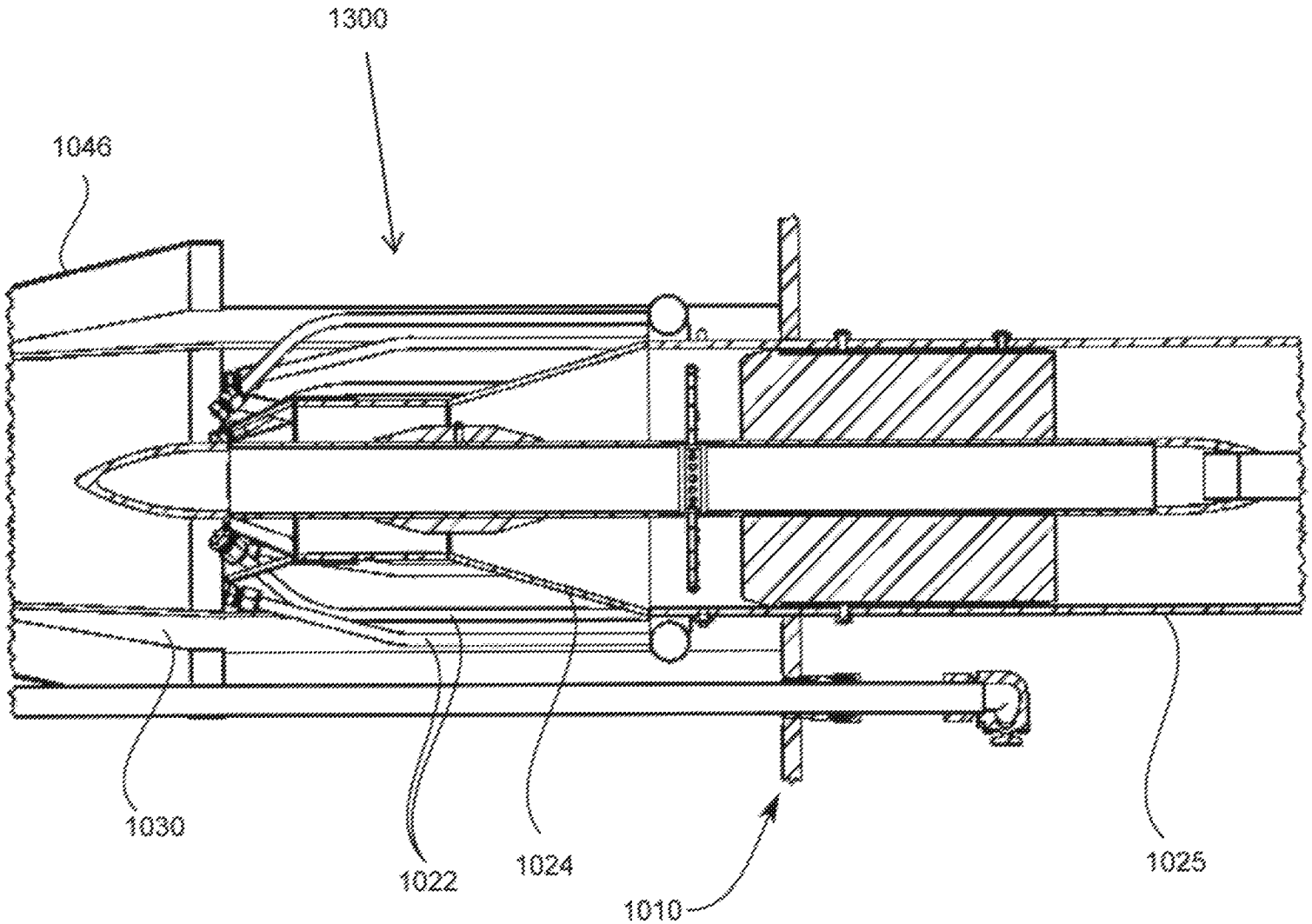
FIG. 13 is a side cutaway view of a burner assembly of an integrated combustion assembly.
Figure 14:
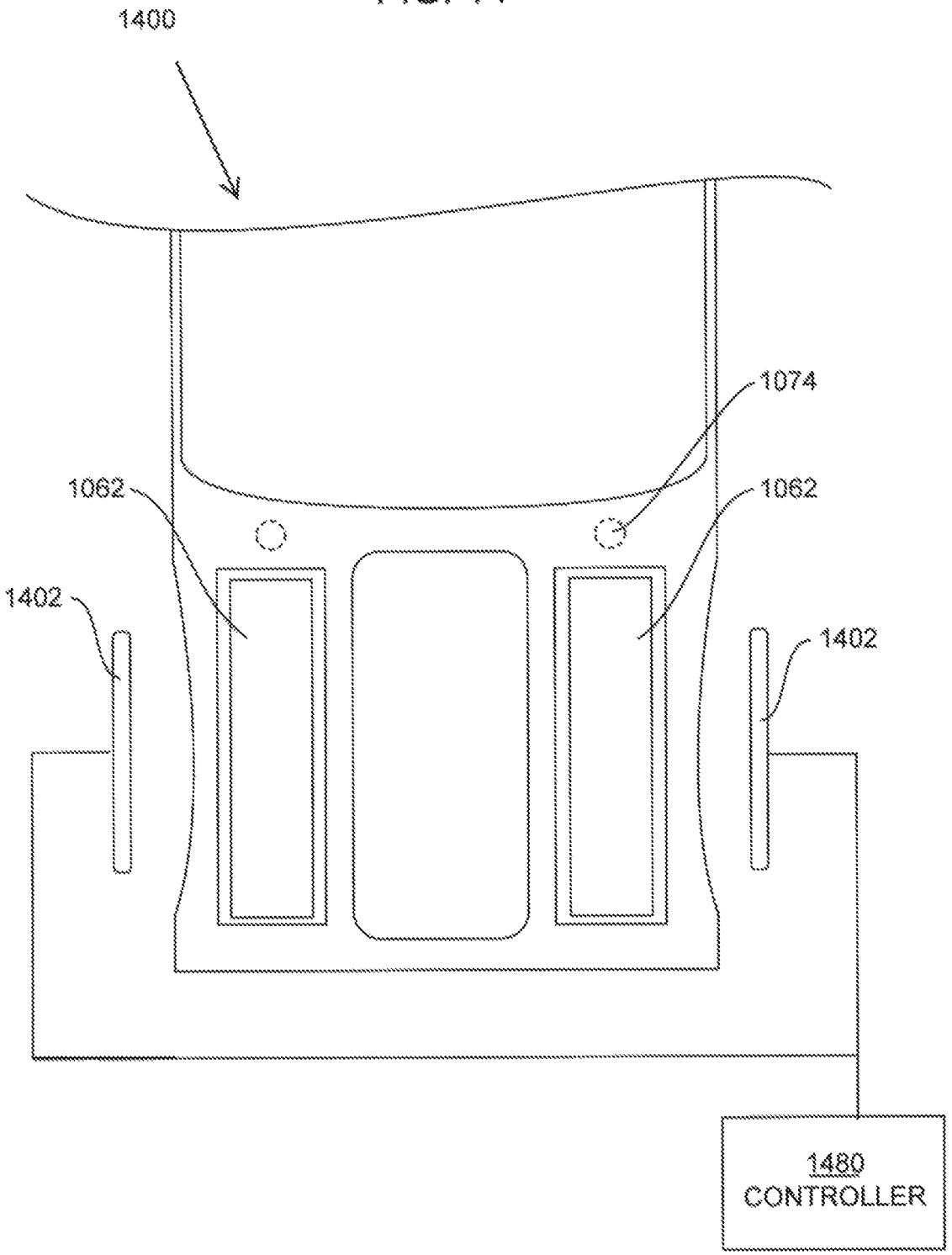
FIG. 14 is a top block view of a distal flame holder of an integrated combustion assembly, according to an embodiment.

FIG. 10 is a perspective view of an integrated combustion assembly 1000 according to an embodiment. FIG. 11 is a side cutaway view of an integrated combustion assembly 1100, according to an embodiment. FIG. 12 is partial view of a distal end of an integrated combustion assembly 1200, including a distal flame holder 1060 and pilot burner 1070, according to an embodiment. FIG. 13 is a side cutaway view of a burner assembly 1300 of the integrated combustion assembly of FIGS. 10-12, according to an embodiment. FIG. 14 is a top block view including a distal flame holder 1060 of an integrated combustion assembly 1400, according to an embodiment.

Referring to FIGS. 10-14, an integrated combustion assembly 1000 may include a mounting flange 1010 mountable to a surface 111 of a combustion chamber 220 (e.g., see FIGS. 1, 2, 4, reference 111). The mounting flange includes a mounting face 1012 and a back face 1014. A fuel and combustion air source 1020 may be operatively coupled to the mounting flange 1010, the fuel and combustion air source 1020 including at least one main fuel nozzle 1022 and a combustion air source 1024. The at least one main fuel nozzle 1022 and the combustion air source 1024 are respectively configured to introduce a main fuel and combustion air into the combustion chamber in co-flow. One or more first supports 1030 may be operatively coupled to the mounting flange 1010 and extend from the mounting face 1012 of the mounting flange 1010. A mixing tube 1040 may be operatively coupled to the one or more first supports 1030 and aligned to receive the main fuel and the combustion air. The mixing tube 1040 is disposed to facilitate mixing of the main fuel and the combustion air between an inlet 1042 and an outlet 1044 of the mixing tube 1040. One or more second supports 1050 may be operatively coupled to the mixing tube and extend from the outlet end of the mixing tube. A distal flame holder 1060 is supported by the one or more second supports 1050. The distal flame holder may be positioned at a first predetermined distance (dd) from the mounting face 1012 of the mounting flange 1010. The distal flame holder 1060 may be positioned a second predetermined distance (dt) from the at least one main fuel nozzle 1022.

According to an embodiment, the one or more first supports 1030 and the one or more second supports 1050 are the same one or more supports. According to an embodiment, wherein the one or more first supports 1030 are extensions of the mixing tube 1040. According to an embodiment the one or more second supports 1030 are extensions of the mixing tube 1040. According to an embodiment, the distal flame holder 1060, the mixing tube 1040, the one or more first supports 1030, and the one or more second supports 1050 are supported by cantilever from the mounting flange 1010.

The integrated combustion assembly 1000 may include a combustion air source 1024 that includes a tubular member 1025 defining an oxidant outlet 350. The tubular member 1025 may be integrated with the mounting flange 1010. The at least one main fuel nozzle 1022 may be attached to and positioned at least partially within a perimeter of the tubular member 1025.

The mixing tube 1040 of the integrated combustion assembly 1000 may include an inlet 1042 including a flared portion 1046. The flared portion 1046 may have a first perimeter 1046*a* at an extent proximate the fuel and combustion air source. The mixing tube 1040 may have a second perimeter 1046*b* where the flared portion 1046 joins the mixing tube 1040. The first perimeter is larger than the second perimeter. The perimeter of the flared portion 1046 may change with m distance from the mounting flange 1010 between the first perimeter and the second perimeter. The change with distance may be linear or may include a bell-shaped portion.

The distal flame holder 1060 may be made up of plural flame holding elements 1062. The plural flame holding elements 1062 may be disposed at a range of distances (not shown) from the fuel and combustion air source 1020.

The integrated combustion assembly 1000 may include a pilot burner 1070 disposed between the fuel and combustion air source 1020 and the distal flame holder 1060.

The pilot burner 1070 may be disposed proximate to the distal flame holder 1060. Additionally or alternatively, the distal flame holder 1060 may be made up of plural flame holding elements 1620 disposed at a range of distances from the fuel and combustion air source 1020. The pilot burner 1070 may be disposed between a first flame holding element most proximal to the fuel and combustion air source 1020 and a second flame holding element most distal from the fuel and combustion air source 1020.

The integrated combustion assembly 1000, may include a fuel valve 270 operably coupled to a fuel supply (not shown) and a controller 280 operatively coupled to the fuel valve 270 to control fuel flow to, and hence, combustion in the integrated combustion assembly 1000. The integrated combustion assembly 1000 may include one or more sensors 381*d*, 382*d* coupled to the controller (280). The controller 280 may be operable to control combustion in the integrated combustion assembly 1000 by controlling fuel flow through the fuel valve 270 at least partially based on one or more signals received from the one or more sensors. The one or more sensors 381*d*, 382*d* may include one or more electro-capacitive sensors. The one or more sensors 381*d*, 382*d* may include one or more ultraviolet sensors 381*d* configured to detect a combustion byproduct or one or more infrared sensors 382*d* configured to sense a temperature of the distal flame holder 1060.

The integrated combustion assembly 1000 may include a flame sensor 1400 disposed proximate the distal flame holder 1060. The flame sensor 1400 may be configured to distinguish between a pilot flame of the pilot burner 1070 and a main flame supported by the at least one main fuel nozzle 1022. The flame sensor 1400 may include an electro-capacitive sensor. The electro-capacitive sensor may include one or more sensor electrodes 1402 positioned adjacent to or within the combustion chamber 220 configured to sense a combustion reaction of the fuel and the oxidant at a sensed combustion location (such as at the pilot burner 1070 and/or at the distal flame holder 1060).

The integrated combustion assembly 1000 may include a pilot fuel pipe 1007 configured to supply fuel to the pilot burner 1070. The pilot fuel pipe 1072 may be disposed outside the mixing tube 1040.

According to an embodiment, a burner 1000 configured for deployment in a fire-tube boiler (e.g., see 100, FIG. 1) includes a mounting flange 1010 configured to be coupled to a base (e.g., 111, FIG. 1) of a fire-tube boiler peripheral to a furnace opening. For example, the "base" of the fire-tube boiler may include a smoke box wall. The terms "base of a fire-tube boiler" and "surface of a combustion chamber" may be considered synonymous, unless context indicates to the contrary. At least one main fuel nozzle 1022 configured to direct flow of a main fuel may be disposed proximate to the mounting flange 1010. A combustion air source 1024 configured to provide a flow of combustion air may be operatively coupled to the mounting flange 1010. A support member 1030 may be operatively coupled to the mounting flange 1010 and configured to provide cantilevered support to the burner, such as in a horizontal cylindrical furnace within the fire-tube boiler 100. A distal pilot burner 1070 may be operatively coupled to the support member 1030. A distal flame holder 1060 may be operatively coupled to the support member 1030.

The at least one main fuel nozzle 1022 may be operatively coupled to the mounting flange 1010. Additionally or alternatively, the at least one main fuel nozzle 1022 may be operatively coupled to the support member 1030.

The distal pilot burner 1070 and the distal flame holder 1060 may be positioned to receive the main fuel and the combustion air at a distance from the mounting flange 1010 sufficient to allow mixing of the main fuel and the combustion air.

The burner 1000 may include a mixing tube 1040 operatively coupled to the support member 1030, the mixing tube being disposed between the mounting flange 1010 and the distal flame holder 1060. The mixing tube 1040 may have an inlet 1042 at an end proximate the mounting flange 1010 and an outlet 1044 at an end proximate the distal flame holder 1060 (i.e., the outlet 1044 being distal from the mounting flange 1010). The mixing tube 1040 is aligned with the fuel and combustion air flow axis (shown as "flame axis" in FIG. 10) to promote mixing of the main fuel and the combustion air. Referring the label "flame axis", it is to be understood that this label is made for ease of understanding. In some embodiments, combustion is "flameless" in that there may be no visible flame surface.

The distal pilot burner 1070 and the distal flame holder 1060 may be operatively connected to the support member 1030 via the mixing tube 1040. In other words, the mixing tube 1040 wall and/or extensions therefrom may form some or all of the support member 1030. E.g., the mixing tube 1040 may form a portion of the support member 1040.

The mixing tube 1040 may be aligned to cause the combustion air and the main fuel flow to educe flue gas into the inlet 1042 of the mixing tube 1040. The mixing tube 1040 may be configured to promote mixing of the main fuel, the combustion air, and the flue gas. This mixing may be used to ensure lean-burning, low $NO_x$ combustion, while minimizing excess oxygen generally associated with lean-burning systems. The distal pilot burner 1070 may provide guaranteed combustion of the main fuel, combustion air, and flue gas mixture at or near the lean combustion limit of the main fuel.

The mixing tube 1040 may include a flared portion (aka, "bell mouth") 1046 at the inlet 1042. The flared portion 1046 may have a first perimeter 1046*a* at an extent proximate the mounting flange 1010 and a second perimeter 1046*b* farther away from the mounting flange 1010 where the flared portion 1046 joins the mixing tube 1040, the first perimeter 1046*a* being larger than the second perimeter 1046*b*. The perimeter of the flared portion 1046 may decreases linearly between the first perimeter 1046*a* and the second perimeter 1046*b* (e.g., akin to a cone or frustrum) or may decrease non-linearly (e.g., akin to a bell of brass musical instrument).

The burner 1000 may include a combustion sensor 1400 operatively coupled to the support member, the combustion sensor 1400 being disposed to sense a combustion reaction proximate the distal flame holder 1060. The combustion sensor 1400 may optionally be configured to distinguish between a pilot flame produced by the distal pilot burner and main combustion supported by the distal flame holder 1060. This may be accomplished by alignment of the m sensor relative to sensed regions respectively associated with the distal pilot flame and main combustion. Additionally or alternatively, distinguishing between the pilot flame and main combustion may be accomplished by a magnitude of a sensed signal, main combustion producing a larger difference from a no-flame condition.

The combustion sensor 1400 may include an electro-capacitive sensor. An electro-capacitive sensor includes one or more sensor electrodes 1402 that may be positioned within the horizontal cylindrical furnace and configured to sense a concentration of charged particles associated with combustion at a sensed combustion location. The charged particles may include combustion reaction byproducts or reaction intermediates, which may include species such as free electrons, OH−, CHO+, H+, etc. According to embodiments, the one or more sensor electrodes 1402 are supported by the support member 1030, the distal pilot burner 1070, and/or the mixing tube 1040.

The burner 1000 may include a controller 1480 operatively coupled to the combustion sensor 1400 and configured to control the distal pilot burner 1060 and/or main combustion based on a signal received from the combustion sensor 1400. The combustion sensor 1400 may be analogous to the combustion sensor 280 described above. The burner 1000 may include a fuel supply valve (e.g., see FIG. 2, 270) operatively connected between a fuel supply (not shown) and the at least one main fuel nozzle 1022. The controller 1480 may be configured to control main combustion by controlling the fuel supply valve 270 based on the signal received from the combustion sensor 1400.

The burner 1000 may include a distal support leg 1090 configured to swing outward (e.g., downward) with respect to the distal flame holder 1060 to provide support for the distal flame holder 1060, the distal pilot burner 1070, and/or a mixing tube 1040 after the support member 1030, the distal pilot burner, the distal flame holder 1060, and/or the mixing tube 1040 are inserted through the furnace opening. The distal support leg 1090 may be configured to engage a wall of the fire-tube boiler 100 to partially support the weight of the burner 1000.

The burner 1000 may further include a mixing tube 1040 disposed between the mounting flange 1010 and the distal flame holder 1060. The mixing tube 1040 may having an inlet 1042 at an end proximate the mounting flange 1010 and an outlet 1044 at a distal end of the mixing tube 1040 proximate the distal flame holder (1060). The distal support leg 1090 may be secured to the distal end of the mixing tube 1040.

The distal pilot burner 1070 may be disposed between the mounting flange 1010 and the distal flame holder 1060. For example, the distal pilot burner 1070 may be disposed proximate the distal flame holder 1060. The distal pilot burner 1070 may be disposed to provide heat energy to a proximal portion of the distal flame holder 1060 to prepare the burner 1000 for a flow of main fuel, such that the main fuel is ignited partially by the distal pilot and partially by a surface of the distal flame holder 1060 above an autoignition temperature of the main fuel. The distal pilot burner 1070 may include at least one pilot fuel nozzle 1074 configured to emit pilot fuel for mixture with the combustion air. In another embodiment, the distal pilot burner 1070 may include a pre-mix burner configured to receive pilot combustion air, premix the pilot combustion air and pilot fuel, and output a premixed pilot flame.

The distal flame holder 1060 may include one or more perforated flame holder tiles 1062. Each of the one or more perforated flame holder tiles 1062 may be characterized by a width dimension (w) and a depth dimension (d), each perforated flame holder tile 1062 being oriented with the width dimension approximately perpendicular to a flame propagation axis and the depth dimension being approximately parallel to the flame propagation axis. In an embodiment, the width dimension is smaller than the depth dimension. A pair of the one or more perforated flame holder tiles 1062 may be spaced from each other across the flame propagation axis.

While various aspects and embodiments have been disclosed herein, other aspects and embodiments are contemplated. The various aspects and embodiments disclosed herein are for purposes of illustration and are not intended to be limiting.

What is claimed is:

1. An integrated combustion assembly, comprising:

a mounting flange mountable to a surface of a combustion chamber, the mounting flange including a mounting face and a back face;

a fuel and combustion air source operatively coupled to the mounting flange, the fuel and combustion air source including at least one main fuel nozzle and a combustion air source;

one or more first supports operatively coupled to the mounting flange at first end portions of the one or more first supports and extending from and substantially normal to the mounting face of the mounting flange;

a mixing tube operatively coupled to second end portions of the one or more first supports, the one or more first supports supporting the mixing tube a first distance spaced from the mounting flange, an inlet of the mixing tube aligned proximate the at least one main fuel nozzle and aligned to receive a main fuel and combustion air and disposed to facilitate mixing of the main fuel and the combustion air along substantially the entire length of the mixing tube between the inlet of the mixing tube and an outlet of the mixing tube;

one or more second supports operatively coupled to the mixing tube and longitudinally extending from the outlet end of the mixing tube; and a distal flame holder supported by the one or more second supports at a second distance from the outlet of the mixing tube, the distal flame holder being positioned at a third predetermined distance ($d_d$) from the mounting face of the mounting flange, wherein, the at least one main fuel nozzle and the combustion air source are respectively configured to introduce the main fuel and the combustion air to the mixing tube in co-flow at or proximate to the inlet of the mixing tube.

2. The integrated combustion system of claim 1, wherein the distal flame holder is positioned at a fourth predetermined distance ($d_t$) from the at least one main fuel nozzle.

3. The integrated combustion system of claim 1, wherein the one or more first supports are substantially longitudinal extensions of the mixing tube.

4. The integrated combustion system of claim 1, wherein the one or more second supports are extensions of the mixing tube.

5. The integrated combustion system of claim 1, wherein the distal flame holder, the mixing tube, the one or more first supports, and the one or more second supports are all cantilevered from a same side of the mounting flange.

6. The integrated combustion assembly of claim 1, further comprising:

a fuel valve operably coupled to a fuel supply; and a controller operatively coupled to the fuel valve to control combustion in the integrated combustion assembly.

7. The integrated combustion assembly of claim 6, further comprising:

one or more sensors coupled to the controller;

wherein the controller is configured to control combustion in the integrated combustion assembly at least partially based on one or more signals received from the one or more sensors.

8. The integrated combustion assembly of claim 7, wherein the one or more sensors includes one or more electro-capacitive sensors.

9. The integrated combustion assembly of claim 1, wherein the inlet of the mixing tube includes a flared portion, the flared portion having a first perimeter at an extent proximate the fuel and combustion air source and a second perimeter where the flared portion joins the mixing tube, the first perimeter being larger than the second perimeter.

10. The integrated combustion assembly of claim 9, wherein the perimeter of the flared portion changes in a linear proportion with distance between the first perimeter and the second perimeter.

11. The integrated combustion assembly of claim 10, wherein the distal flame holder is made up of plural flame holding elements, the plural flame holding elements respectively disposed at a range of distances from the fuel and combustion air source.

12. The integrated combustion assembly of claim 1, further comprising a pilot burner disposed between the fuel and combustion air source and the distal flame holder.

13. The integrated combustion assembly of claim 12, wherein the pilot burner is disposed proximate to the distal flame holder.

14. The integrated combustion assembly of claim 12, further comprising a flame sensor disposed proximate the distal flame holder.

15. The integrated combustion assembly of claim 14, wherein the flame sensor is configured to distinguish between a pilot flame of the pilot burner and a main flame supported by the at least one main fuel nozzle.

16. The integrated combustion assembly of claim 14, wherein the flame sensor includes an electro-capacitive sensor.

17. The integrated combustion assembly of claim 16, wherein the electrocapacitive sensor includes one or more sensor electrodes positioned adjacent to or within the combustion chamber and configured to sense a combustion reaction of the main fuel and the combustion air at a sensed combustion location.

18. The integrated combustion assembly of claim 12, further comprising a pilot fuel pipe configured to supply fuel to the pilot burner.

19. The integrated combustion assembly of claim 18, wherein the pilot fuel pipe is disposed along an exterior surface of the mixing tube.

20. The integrated combustion assembly of claim 1, wherein the combustion air source includes a tubular member defining a combustion air outlet, the tubular member being integrated with the mounting flange, and one or more of the at least one main fuel nozzle being attached to and positioned at least partially within a perimeter of the tubular member.

* * * * *